US010407865B2

(12) United States Patent
Kamoshita et al.

(10) Patent No.: US 10,407,865 B2
(45) Date of Patent: Sep. 10, 2019

(54) CONTROL SYSTEM, WORK MACHINE, AND CONTROL METHOD

(71) Applicant: Komatsu Ltd., Tokyo (JP)

(72) Inventors: Yuta Kamoshita, Hiratsuka (JP); Tadashi Kawaguchi, Hiratsuka (JP); Teruo Akiyama, Kokubunji (JP); Kenji Oshima, Tokyo (JP)

(73) Assignee: Komatsu Ltd., Tokyo (JP)

( * ) Notice: Subject to any disclaimer, the term of this patent is extended or adjusted under 35 U.S.C. 154(b) by 176 days.

(21) Appl. No.: 15/509,008

(22) PCT Filed: Aug. 26, 2016

(86) PCT No.: PCT/JP2016/075091
§ 371 (c)(1),
(2) Date: Mar. 6, 2017

(87) PCT Pub. No.: WO2018/037567
PCT Pub. Date: Mar. 1, 2018

(65) Prior Publication Data
US 2018/0230670 A1 Aug. 16, 2018

(51) Int. Cl.
*E02F 9/22* (2006.01)
*E02F 3/43* (2006.01)
(Continued)

(52) U.S. Cl.
CPC ..... *E02F 3/435* (2013.01); *E02F 3/32* (2013.01); *E02F 9/123* (2013.01); *E02F 9/2004* (2013.01);
(Continued)

(58) Field of Classification Search
CPC ..... E02F 9/2239
See application file for complete search history.

(56) References Cited

U.S. PATENT DOCUMENTS 5,063,739 A * 11/1991 Bianchetta ..... F15B 11/17 60/421
7,788,915 B2 9/2010 Shiozaki et al.
(Continued)

FOREIGN PATENT DOCUMENTS

CN 102839709 A 12/2012
GB 2464882 B 5/2010
(Continued)

OTHER PUBLICATIONS

International Search Report and Written Opinion dated Nov. 15, 2016, issued for PCT/JP2016/075091.

*Primary Examiner* — F Daniel Lopez
(74) *Attorney, Agent, or Firm* — Locke Lord LLP

(57) ABSTRACT

A control system includes: a first hydraulic pump and a second hydraulic pump; a passage connecting the first hydraulic pump and the second hydraulic pump with each other; an opening/closing device provided in the passage and configured to open and close the passage; a control device configured to control the opening/closing device to switch between a split-flow state in which the passage is closed and a connected state in which the passage is open; a first actuator to which hydraulic fluid discharged from the first hydraulic pump is supplied in the split-flow state; and a second actuator to which hydraulic fluid discharged from the second hydraulic pump is supplied in the split-flow state. In the connected state, the control device controls the opening/closing device so that the connected state is maintained even when either one of the first actuator and the second actuator is brought into a driven state.

5 Claims, 9 Drawing Sheets

(51) Int. Cl.

| | |
|---|---|
| ***F15B 11/17*** | (2006.01) |
| ***E02F 3/32*** | (2006.01) |
| ***E02F 9/12*** | (2006.01) |
| ***E02F 9/20*** | (2006.01) |
| ***F15B 13/06*** | (2006.01) |
| *E02F 3/42* | (2006.01) |

(52) U.S. Cl.

CPC ..... *E02F 9/2075* (2013.01); *E02F 9/2225* (2013.01); *E02F 9/2239* (2013.01); *E02F 9/2242* (2013.01); *E02F 9/2267* (2013.01); *E02F 9/2271* (2013.01); *E02F 9/2292* (2013.01); *E02F 9/2296* (2013.01); *F15B 11/17* (2013.01); *F15B 13/06* (2013.01); *E02F 3/425* (2013.01); *F15B 2211/40546* (2013.01)

(56) References Cited

U.S. PATENT DOCUMENTS

| | | | |
|---|---|---|---|
| 7,992,384 | B2 | 8/2011 | Itakura et al. |
| 10,017,917 | B2 | 7/2018 | Kawaguchi et al. |
| 2007/0220880 | A1 | 9/2007 | Kubinski |
| 2009/0057040 | A1 | 3/2009 | Yamada et al. |
| 2012/0167561 | A1* | 7/2012 | Ono ..... B60K 6/46 60/486 |
| 2012/0330516 | A1 | 12/2012 | Horii |
| 2013/0298545 | A1 | 11/2013 | Berg |
| 2017/0022688 | A1 | 1/2017 | Kubo |
| 2017/0121940 | A1 | 5/2017 | Kawaguchi et al. |

FOREIGN PATENT DOCUMENTS

| | | | |
|---|---|---|---|
| JP | 06-040406 | U | 5/1994 |
| JP | H09210005 | A | 8/1997 |
| JP | 11-158941 | A | 6/1999 |
| JP | 2004-036681 | A | 2/2004 |
| JP | 2013079552 | A | 5/2013 |
| KR | 20160096081 | A | 8/2016 |
| WO | 2006/123704 | A1 | 11/2006 |
| WO | 2007/132691 | A1 | 11/2007 |
| WO | 2011/114929 | A1 | 9/2011 |
| WO | 2016056675 | A1 | 4/2016 |

* cited by examiner

CONTROL SYSTEM, WORK MACHINE, AND CONTROL METHOD

FIELD

The present invention relates to a control system, a work machine, and a control method.

BACKGROUND

A work machine with a working unit including a plurality of working unit components is known. For example, in a case where the work machine is an excavator, a working unit of the excavator includes a bucket, an arm, and a boom, which are working unit components. A hydraulic cylinder is used as an actuator for driving the working unit components. A hydraulic pump that discharges hydraulic fluid is used as a driving source for the hydraulic cylinder. A work machine including a plurality of hydraulic pumps for driving hydraulic cylinders is known. Patent Literature 1 discloses a hydraulic circuit including a merging/diverging valve for switching between merging and diverging of hydraulic fluid discharged from a first hydraulic pump and hydraulic fluid discharged from a second hydraulic pump.

CITATION LIST

Patent Literature

Patent Literature 1: WO2006/123704 A

SUMMARY

Technical Problem

In the hydraulic circuit, hydraulic fluid at a flow rate corresponding to a minimum capacity is discharged from the hydraulic pumps even while the hydraulic cylinders are not driven. The hydraulic fluid discharged from the hydraulic pumps while the hydraulic cylinders are not driven is unloaded via the unloader valves. For example, in a split-flow state in which a passage connecting the first hydraulic pump and the second hydraulic pump with each other is closed, when a first actuator connected to the first hydraulic pump is driven but a second actuator connected to the second hydraulic pump is not driven, hydraulic fluid discharged from the first hydraulic pump is supplied to the first actuator, but hydraulic fluid discharged from the second hydraulic pump is unloaded via an unloader valve. A large amount of unloaded hydraulic fluid means that the hydraulic pump is wastefully driven, which lowers the fuel efficiency of the work machine, for example.

Aspects of the present invention aim at providing a control system, a work machine, and a control method capable of reducing unloaded hydraulic fluid when hydraulic fluid is supplied from a plurality of hydraulic pumps to actuators.

Solution to Problem

According to a first aspect of the present invention, a control system configured to control a work machine including a working unit having a plurality of working unit components, and a plurality of actuators configured to drive the respective working unit components, the control system comprises: a first hydraulic pump and a second hydraulic pump; a passage connecting the first hydraulic pump and the second hydraulic pump with each other; an opening/closing device provided in the passage and configured to open and close the passage; a control device configured to control the opening/closing device to switch between a split-flow state in which the passage is closed and a connected state in which the passage is open; a first actuator to which hydraulic fluid discharged from the first hydraulic pump is supplied in the split-flow state; and a second actuator to which hydraulic fluid discharged from the second hydraulic pump is supplied in the split-flow state, wherein in the connected state, the control device controls the opening/closing device to maintain the connected state even when either one of the first actuator and the second actuator is brought into a driven state.

According to a second aspect of the present invention, a work machine comprises the control system according to the first aspect.

According to a third aspect of the present invention, a control method for controlling a work machine including a working unit having a plurality of working unit components, and a plurality of actuators configured to drive the respective working unit components, the control method comprises: switching between a split-flow state in which a passage connecting a first hydraulic pump and a second hydraulic pump is closed and a connected state in which the passage is open; supplying hydraulic fluid discharge from the first hydraulic pump to a first actuator and supplying hydraulic fluid discharged from the second hydraulic pump to a second actuator in the split-flow state; and in the connected state, maintaining the connected state even when either one of the first actuator and the second actuator is brought into a driven state, and supplying hydraulic fluid discharged from the first hydraulic pump and the second hydraulic pump to an actuator in a driven state.

Advantageous Effects of Invention

According to the aspects of the present invention, a control system, a work machine, and a control method capable of reducing unloaded hydraulic fluid when hydraulic fluid is supplied from a plurality of hydraulic pumps to actuators are provided.

DESCRIPTION OF EMBODIMENTS

An embodiment according to the present invention will be described below with reference to the drawings; the present invention, however, is not limited thereto. Components in the embodiment described below can be combined as appropriate. Furthermore, some of the components may not be used.

[Work Machine]

Figure 1:
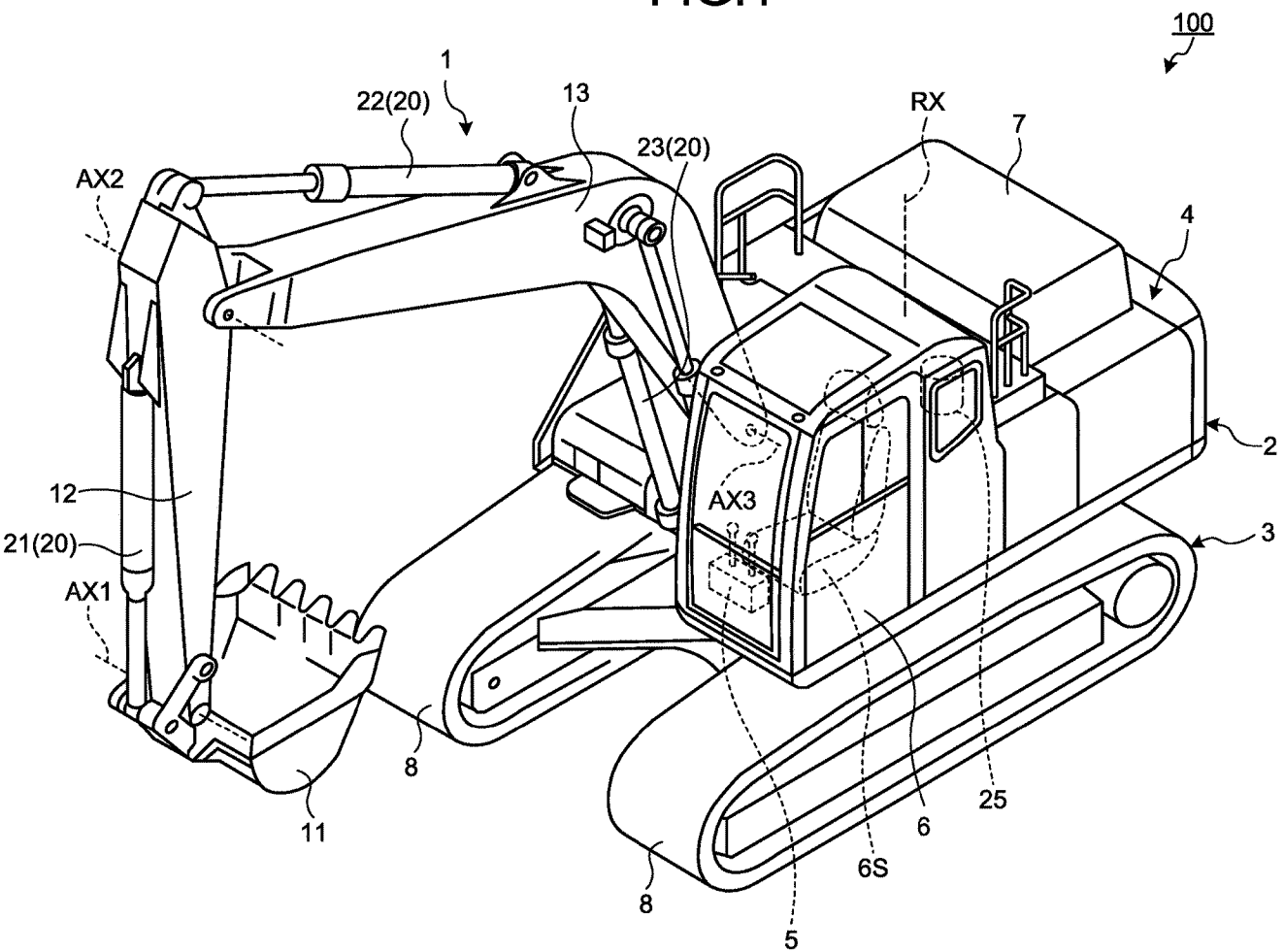
FIG. 1 is a perspective view illustrating an example of a work machine according to an embodiment.

FIG. 1 is a perspective view illustrating an example of a work machine 100 according to the embodiment. In the present embodiment, an example in which the work machine 100 is a hybrid excavator will be described. In the description below, the work machine 100 will also be referred to as an excavator 100 where appropriate.

As illustrated in FIG. 1, the excavator 100 includes a hydraulically actuated working unit 1, an upper swing structure 2 that is a swing structure supporting the working unit 1, a lower traveling structure 3 supporting the upper swing structure 2, a drive 4 that drives the excavator 100, and an operating device 5 for operating the working unit 1.

The upper swing structure 2 is capable of swinging about a swing axis RX. The upper swing structure 2 includes a cab 6 into which an operator climbs, and a machinery room 7. A driver's seat 6S on which an operator sits is provided in the cab 6. The machinery room 7 is located behind the cab 6. At least part of the drive 4 including an engine, a hydraulic pump, and the like are located in the machinery room 7. The lower traveling structure 3 includes a pair of crawlers 8. The excavator 100 travels by the rotation of the crawlers 8. Alternatively, the lower traveling structure 3 may include wheels (tires).

The working unit 1 is supported by the upper swing structure 2. The working unit 1 includes a plurality of working unit components that are movable relative to one another. The working unit components of the working unit 1 include a bucket 11, an arm 12 coupled to the bucket 11, and a boom 13 coupled to the arm 12. The bucket 11 and the arm 12 are coupled to each other with a bucket pin. The bucket 11 is supported by the arm 12 rotatably about a rotation axis AX1. The arm 12 and the boom 13 are coupled to each other with an arm pin. The arm 12 is supported by the boom 13 rotatably about a rotation axis AX2. The boom 13 and the upper swing structure 2 are coupled to each other with a boom pin. The boom 13 is supported by the lower traveling structure 3 rotatably about a rotation axis AX3.

The rotation axis AX3 and an axis parallel to the swing axis RX are at right angles to each other. In the description below, the axial direction of the rotation axis AX3 will be referred to as a vehicle width direction of the upper swing structure 2 where appropriate, and a direction perpendicular to both of the rotation axis AX3 and the swing axis RX will be referred to as a front-back direction of the upper swing structure 2 where appropriate. A direction in which the working unit 1 is present relative to the swing axis RX is the front direction. A direction in which the machinery room 7 is present relative to the swing axis RX is the back direction.

The drive 4 has hydraulic cylinders 20 for actuating the working unit 1, and an electric swing motor 25 for generating power to swing the upper swing structure 2. The hydraulic cylinders 20 are driven by hydraulic fluid. The hydraulic cylinders 20 include a bucket cylinder 21 for actuating the bucket 11, an arm cylinder 22 for actuating the arm 12, and a boom cylinder 23 for actuating the boom 13. The upper swing structure 2 is capable of being swung about the swing axis RX by power generated by the electric swing motor 25 in a state in which the upper swing structure 2 is supported by the lower traveling structure 3.

The operating device 5 is disposed in the cab 6. The operating device 5 includes operation members manipulated by the operator of the excavator 100. The operation members include a control lever or a joystick. The working unit 1 is operated by the manipulation of the operating device 5.

[Control System]

Figure 2:
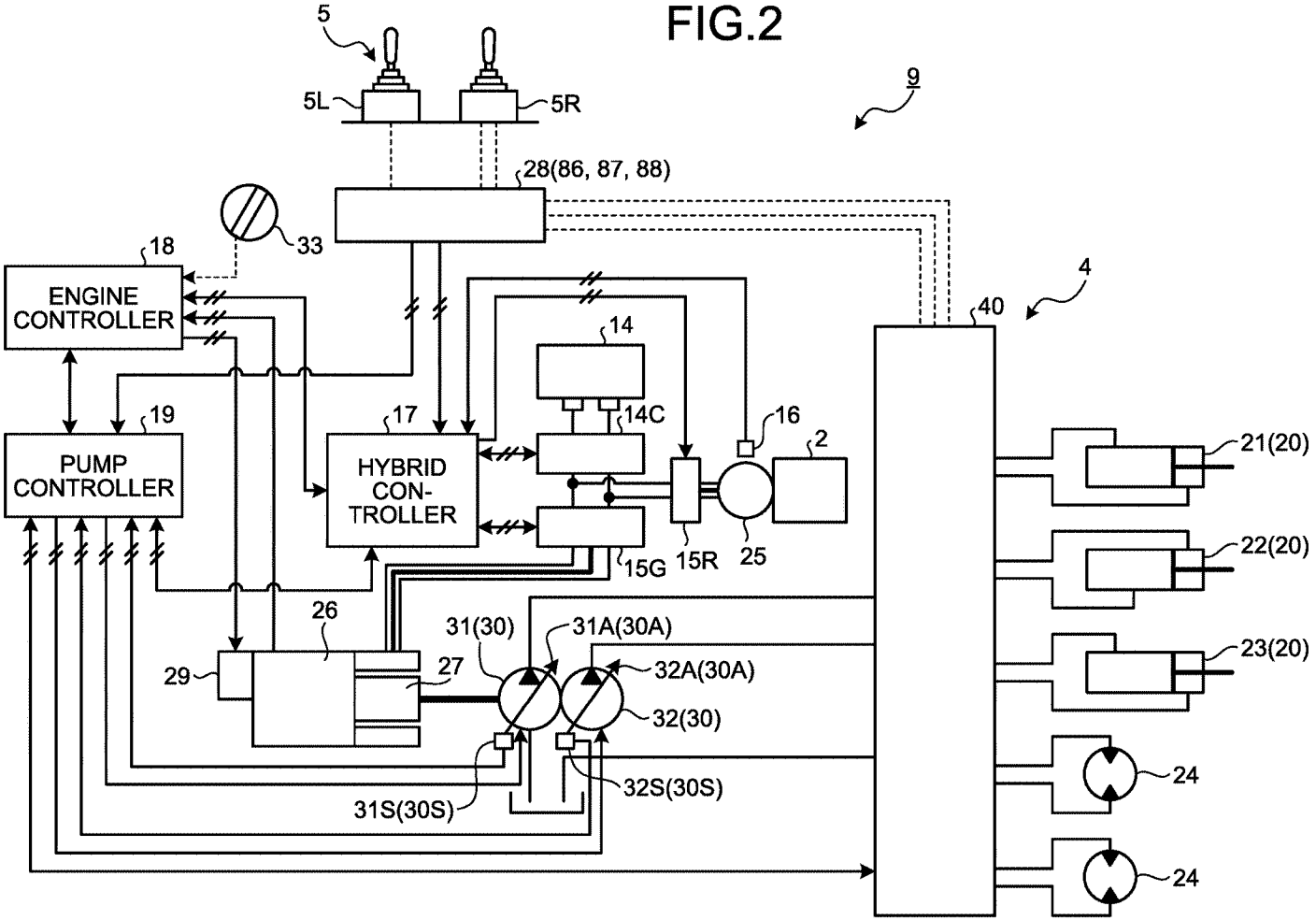
FIG. 2 is a diagram schematically illustrating a control system including a drive of an excavator according to the embodiment.

FIG. 2 is a diagram schematically illustrating a control system 9 including the drive 4 of the excavator 100 according to the present embodiment. The control system 9 is a control system for controlling the excavator 100 including the working unit 1 having a plurality of working unit components and a plurality of actuators for driving the working unit components of the working unit 1. In the present embodiment, the actuators for driving the working unit components are the hydraulic cylinders 20. In the present embodiment, the hydraulic cylinders 20 include the bucket cylinder 21 for actuating the bucket 11, the arm cylinder 22 for actuating the arm 12, and the boom cylinder 23 for actuating the boom 13. Different actuators are used for different working unit components. In the present embodiment, the actuators for driving the working unit 1 are hydraulic actuators driven by hydraulic fluid. The actuators for driving the working unit 1 may be any hydraulic actuators, and are not limited to the hydraulic cylinders 20. The actuators may be hydraulic motors, for example.

The drive 4 includes an engine 26 that is a driving source, a generator motor 27, and hydraulic pumps 30 for discharging hydraulic fluid. The engine 26 is a diesel engine, for example. The generator motor 27 is a switched reluctance motor, for example. Alternatively, the generator motor 27 may be a permanent magnet (PM) motor. The hydraulic pumps 30 are variable displacement hydraulic pumps. In an embodiment, the hydraulic pumps 30 are swash plate hydraulic pumps. The hydraulic pumps 30 include a first hydraulic pump 31 and a second hydraulic pump 32. An output shaft of the engine 26 is mechanically coupled with the generator motor 27 and the hydraulic pumps 30. The generator motor 27 and the hydraulic pumps 30 are actuated by the driving of the engine 26. Note that the generator motor 27 may be mechanically and directly connected to the output shaft of the engine 26 or may be connected to the output shaft of the engine 26 via a power transmission mechanism such as a power take-off (PTO).

The drive 4 includes a hydraulic drive system and an electric drive system. The hydraulic drive system includes the hydraulic pumps 30, a hydraulic circuit 40 through which hydraulic fluid discharged from the hydraulic pumps 30 flows, the hydraulic cylinders 20 actuated by the hydraulic fluid supplied via the hydraulic circuit 40, and travel motors 24. The travel motors 24 are hydraulic motors driven by hydraulic fluid discharged from the hydraulic pumps 30, for example.

The electric drive system includes the generator motor 27, a storage battery 14, a transformer 14C, a first inverter 15G, a second inverter 15R, and the electric swing motor 25. When the engine 26 is driven, a rotor shaft of the generator motor 27 rotates. This enables the generator motor 27 to generate power. The storage battery 14 is an electric double layer storage battery, for example.

A hybrid controller 17 makes the transformer 14C, the first inverter 15G, and the second inverter 15R deliver direct-current power therebetween, and makes the transformer 14C and the storage battery 14 deliver direct-current power therebetween. The electric swing motor 25 operates on the basis of power supplied from the generator motor 27 or the storage battery 14, and generates power to swing the upper swing structure 2. The electric swing motor 25 is interior permanent magnet synchronous electric swing motor, for example. The electric swing motor 25 is provided with a rotation sensor 16. The rotation sensor 16 is a resolver or a rotary encoder, for example. The rotation sensor 16 detects the rotation angle or the rotation speed of the electric swing motor 25.

In the present embodiment, the electric swing motor 25 generates regenerative energy during deceleration. The storage battery 14 is charged by the regenerative energy (electric energy) generated by the electric swing motor 25. Alternatively, the storage battery 14 may be a secondary battery such as a nickel-hydrogen battery or a lithium-ion battery instead of the electric double layer storage battery mentioned above. In addition, the upper swing structure 2 in the present embodiment may be driven with use of a hydraulic motor driven by hydraulic fluid supplied from a hydraulic pump.

The drive 4 operates according to manipulation of the operating device 5 provided in the cab 6. The amount of manipulation of the operating device 5 is detected by a manipulation amount detection unit 28. The manipulation amount detection unit 28 includes a pressure sensor. A pilot fluid pressure generated depending on the amount of manipulation of the operating device 5 is detected by the manipulation amount detection unit 28. The manipulation amount detection unit 28 converts a signal detected by the pressure sensor in to the amount of manipulation of the operating device 5. Note that the manipulation amount detection unit 28 may include an electric sensor such as a potentiometer. In a case where the operating device 5 includes an electric lever, an electrical signal generated depending on the amount of manipulation of the operating device 5 is detected by the manipulation amount detection unit 28.

A throttle dial 33 is provided in the cab 6. The throttle dial 33 is an operation unit for setting a fuel supply amount to be supplied to the engine 26.

The control system 9 includes the hybrid controller 17, an engine controller 18 for controlling the engine 26, and a pump controller 19 for controlling the hydraulic pumps 30. The hybrid controller 17, the engine controller 18, and the pump controller 19 include computer systems. The hybrid controller 17, the engine controller 18, and the pump controller 19 each include a processor such as a central processing unit (CPU), a storage unit such as a read only memory (ROM) or a random access memory (RAM), and an input/output interface unit. Alternatively, the hybrid controller 17, the engine controller 18, and the pump controller 19 may be integrated into one controller.

The hybrid controller 17 regulates the temperatures of the generator motor 27, the electric swing motor 25, the storage battery 14, the first inverter 15G, and the second inverter 15R on the basis of detected signals from temperature sensors provided for the generator motor 27, the electric swing motor 25, the storage battery 14, the first inverter 15G and the second inverter 15R. The hybrid controller 17 performs charging/discharging control on the storage battery 14, power generation control on the generator motor 27, and assist control of the generator motor 27 assisting the engine 26. The hybrid controller 17 controls the electric swing motor 25 on the basis of a detected signal from the rotation sensor 16.

The engine controller 18 generates a command signal on the basis of a setting of the throttle dial 33, and outputs the command signal to a common rail control unit 29 provided in the engine 26. The common rail control unit 29 regulates a fuel injection amount to the engine 26 on the basis of the command signal sent from the engine controller 18.

The pump controller 19 generates a command signal for regulating the flow rate of hydraulic fluid to be discharged from the hydraulic pumps 30 on the basis of a command signal or command signals sent from at least one of the engine controller 18, the hybrid controller 17, and the manipulation amount detection unit 28. In the embodiment, the drive 4 includes two hydraulic pumps 30, which are the first hydraulic pump 31 and the second hydraulic pump 32. The first hydraulic pump 31 and the second hydraulic pump 32 are driven by the engine 26.

The pump controller 19 controls tilt angles that are the tilt angles of swash plates 30A of the hydraulic pumps 30 to regulate the supply amount of hydraulic fluid to be supplied from the hydraulic pumps 30. The hydraulic pumps 30 are provided with swash plate angle sensors 30S for detecting swash plate angles of the hydraulic pumps 30. The swash plate angle sensors 30S include a swash plate angle sensor 31S for detecting the tilt angle of a swash plate 31A of the first hydraulic pump 31 and a swash plate angle sensor 32S for detecting the tilt angle of a swash plate 32A of the second hydraulic pump 32. Detected signals of the swash plate angle sensors 30S are output to the pump controller 19.

The pump controller 19 calculates pump capacities (cc/rev) of the hydraulic pumps 30 on the basis of the detected signals from the swash plate angle sensors 30S. The hydraulic pumps 30 are provided with servomechanisms for driving the swash plates 30A. The pump controller 19 controls the servomechanisms to adjust the swash plate angles. The hydraulic circuit 40 is provided with a pump pressure sensor for detecting pump discharge pressures of the hydraulic pumps 30. A detected signal of the pump pressure sensor is output to the pump controller 19. In an embodiment, the engine controller 18 and the pump controller 19 are connected via an in-vehicle local area network (LAN) such as a controller area network (CAN). The in-vehicle LAN enables mutual transmission and reception of data between the engine controller 18 and the pump controller 19. The pump controller 19 acquires detected values from respective sensors provided in the hydraulic circuit 40, and outputs control commands. Details will be described later.

[Hydraulic Circuit]

Figure 3:
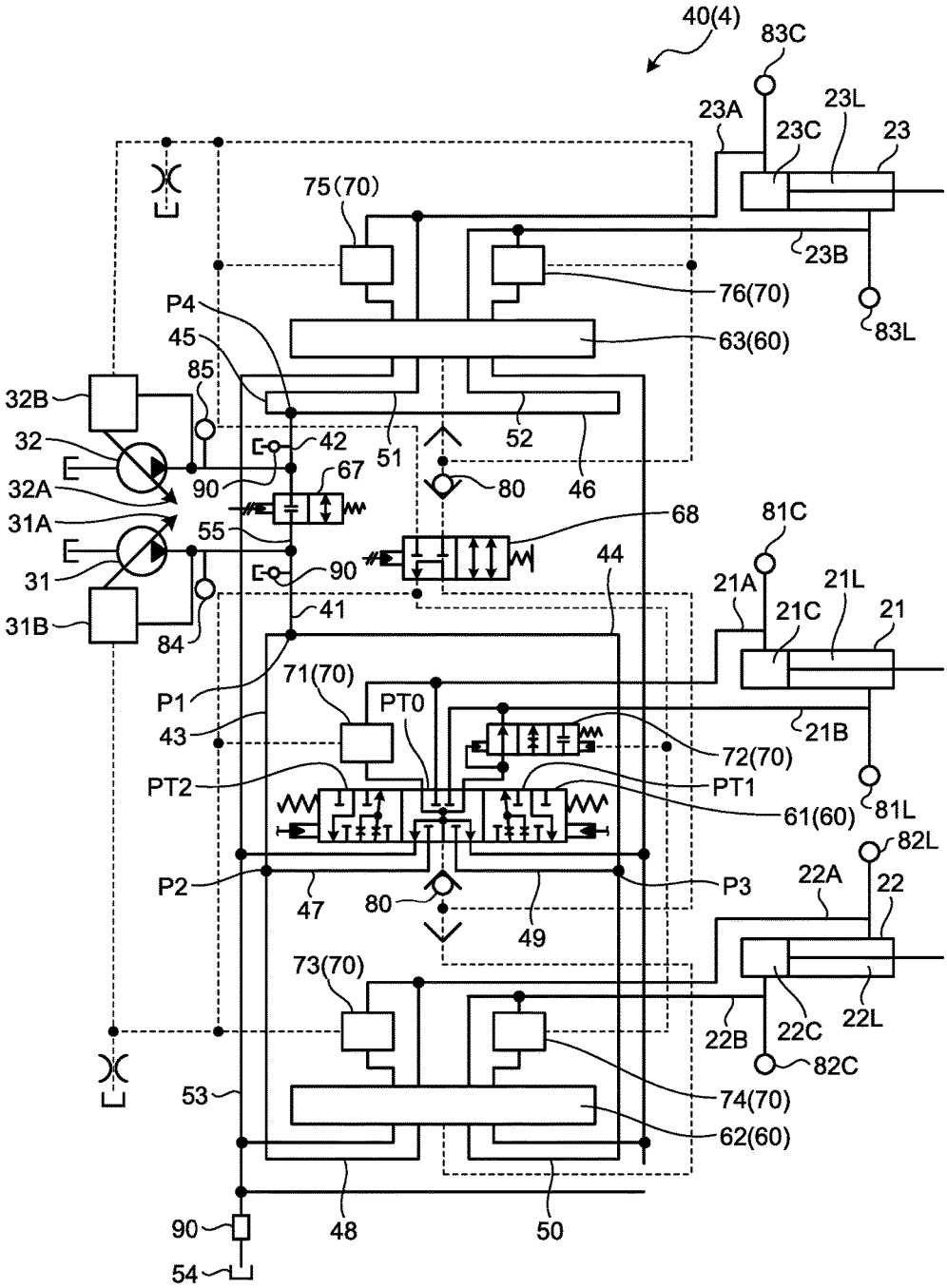
FIG. 3 is a diagram illustrating a hydraulic circuit of the drive according to the embodiment.

FIG. 3 is a diagram illustrating the hydraulic circuit 40 of the drive 4 according to the present embodiment. The drive 4 includes the bucket cylinder 21, the arm cylinder 22, the boom cylinder 23, the first hydraulic pump 31 for discharging hydraulic fluid to be supplied to the bucket cylinder 21 and the arm cylinder 22, and the second hydraulic pump 32 for discharging hydraulic fluid to be supplied to the boom cylinder 23. The hydraulic fluid discharged from the first hydraulic pump 31 and the second hydraulic pump 32 flows through the hydraulic circuit 40.

The hydraulic circuit 40 includes a first pump passage 41 connected with the first hydraulic pump 31, and a second pump passage 42 connected with the second hydraulic pump 32. The hydraulic circuit 40 includes a first supply passage 43 and a second supply passage 44 connected with the first pump passage 41, and a third supply passage 45 and a fourth supply passage 46 connected with the second pump passage 42.

The first pump passage 41 branches into the first supply passage 43 and the second supply passage 44 at a first diverging point P1. The second pump passage 42 branches into the third supply passage 45 and the fourth supply passage 46 at a fourth diverging point P4.

The hydraulic circuit 40 includes a first diverging passage 47 and a second diverging passage 48 connected with the first supply passage 43, and a third diverging passage 49 and a fourth diverging passage 50 connected with the second supply passage 44. The first supply passage 43 branches into the first diverging passage 47 and the second diverging passage 48 at a second diverging point P2. The second supply passage 44 branches into the third diverging passage 49 and the fourth diverging passage 50 at a third diverging point P3. The hydraulic circuit 40 includes a fifth diverging passage 51 connected with the third supply passage 45, and a sixth diverging passage 52 connected with the fourth supply passage 46.

The hydraulic circuit 40 includes a first main operation valve 61 connected with the first diverging passage 47 and the third diverging passage 49, a second main operation valve 62 connected with the second diverging passage 48 and the fourth diverging passage 50, and a third main operation valve 63 connected with the fifth diverging passage 51 and the sixth diverging passage 52.

The hydraulic circuit 40 includes a first bucket passage 21A connecting the first main operation valve 61 with a cap-side space 21C of the bucket cylinder 21, and a second bucket passage 21B connecting the first main operation valve 61 with a rod-side space 21L of the bucket cylinder 21. The hydraulic circuit 40 includes a first arm passage 22A connecting the second main operation valve 62 with a rod-side space 22L of the arm cylinder 22, and a second arm passage 22B connecting the second main operation valve 62 with a cap-side space 22C of the arm cylinder 22. The hydraulic circuit 40 includes a first boom passage 23A connecting the third main operation valve 63 with a cap-side space 23C of the boom cylinder 23, and a second boom passage 23B connecting the third main operation valve 63 with a rod-side space 23L of the boom cylinder 23.

A cap-side space of a hydraulic cylinder 20 is a space between a cylinder head cover and a piston. A rod-side space of a hydraulic cylinder 20 is a space in which a piston rod is disposed. When hydraulic fluid is supplied to the cap-side space 21C of the bucket cylinder 21 and the bucket cylinder 21 thus extends, the bucket 11 performs digging operation. When hydraulic fluid is supplied to the rod-side space 21L of the bucket cylinder 21 and the bucket cylinder 21 thus retracts, the bucket 11 performs dumping operation.

When hydraulic fluid is supplied to the cap-side space 22C of the arm cylinder 22 and the arm cylinder 22 thus extends, the arm 12 performs digging operation. When hydraulic fluid is supplied to the rod-side space 22L of the arm cylinder 22 and the arm cylinder 22 thus retracts, the arm 12 performs dumping operation.

When hydraulic fluid is supplied to the cap-side space 23C of the boom cylinder 23 and the boom cylinder 23 thus extends, the boom 13 performs lifting operation. When hydraulic fluid is supplied to the rod-side space 23L of the boom cylinder 23 and the boom cylinder 23 thus retracts, the boom 13 performs lowering operation.

The working unit 1 is operated by the manipulation of the operating device 5. In an embodiment, the operating device 5 includes a right control lever 5R disposed on the right of the operator seated on the driver's seat 6S, and a left control lever 5L disposed on the left thereof. When the right control lever 5R is moved in the front-back direction, the boom 13 performs lowering operation or lifting operation. When the right control lever 5R is moved in the left-right direction (vehicle width direction), the bucket 11 performs digging operation or dumping operation. When the left control lever 5L is moved in the front-back direction, the arm 12 performs dumping operation or digging operation. When the left control lever 5L is moved in the left-right direction, the upper swing structure 2 swings to the left or to the right. When the left control lever 5L is moved in the front-back direction, the upper swing structure 2 may swing to the right or to the left, and when the left control lever 5L is moved in the left-right direction, the arm 12 may perform dumping operation or digging operation.

The swash plate 31A of the first hydraulic pump 31 is driven by a servomechanism 31B. The servomechanism 31B is actuated on the basis of a command signal from the pump controller 19 and adjusts the tilt angle of the swash plate 31A of the first hydraulic pump 31. The adjustment of the tilt angle of the swash plate 31A of the first hydraulic pump 31 regulates the pump capacity (cc/rev) of the first hydraulic pump 31. Similarly, the swash plate 32A of the second hydraulic pump 32 is driven by a servomechanism 32B. The adjustment of the tilt angle of the swash plate 32A of the second hydraulic pump 32 regulates the pump capacity (cc/rev) of the second hydraulic pump 32.

The first main operation valve 61 is a directional control valve for regulating the direction and the flow rate of hydraulic fluid supplied from the first hydraulic pump 31 to the bucket cylinder 21. The second main operation valve 62 is a directional control valve for regulating the direction and the flow rate of hydraulic fluid supplied from the first hydraulic pump 31 to the arm cylinder 22. The third main operation valve 63 is a directional control valve for regulating the direction and the flow rate of hydraulic fluid supplied from the second hydraulic pump 32 to the boom cylinder 23.

The first main operation valve 61 is a sliding spool directional control valve. A spool of the first main operation valve 61 is movable between a stop position PTO for stopping supply of hydraulic fluid to the bucket cylinder 21 to stop the bucket cylinder 21, a first position PT1 for connecting the first diverging passage 47 with the first bucket passage 21A so that hydraulic fluid is supplied to the cap-side space 21C to extend the bucket cylinder 21, and a second position PT2 for connecting the third diverging passage 49 with the second bucket passage 21B so that hydraulic fluid is supplied to the rod-side space 21L to retract the bucket cylinder 21. The first main operation valve 61 is operated so that the bucket cylinder 21 becomes at least one of a stop state, an extending state, and a retracting state.

The second main operation valve 62 has a structure equivalent to that of the first main operation valve 61. A spool of the second main operation valve 62 is movable between a stop position for stopping supply of hydraulic fluid to the arm cylinder 22 to stop the arm cylinder 22, a second position for connecting the fourth diverging passage 50 with the second arm passage 22B so that hydraulic fluid is supplied to the cap-side space 22C to extend the arm cylinder 22, and a first position for connecting the second diverging passage 48 with the first arm passage 22A so that hydraulic fluid is supplied to the rod-side space 22L to retract the arm cylinder 22. The second main operation valve 62 is operated so that the arm cylinder 22 becomes at least one of a stop state, an extending state, and a retracting state.

The third main operation valve 63 has a structure equivalent to that of the first main operation valve 61. A spool of the third main operation valve 63 is movable between a stop position for stopping supply of hydraulic fluid to the boom cylinder 23 to stop the boom cylinder 23, a first position for connecting the fifth diverging passage 51 with the first boom passage 23A so that hydraulic fluid is supplied to the cap-side space 23C to extend the boom cylinder 23, and a second position for connecting the sixth diverging passage 52 with the second boom passage 23B so that hydraulic fluid is supplied to the rod-side space 23L to retract the boom cylinder 23. The third main operation valve 63 is operated so that the boom cylinder 23 becomes at least one of a stop state, an extending state, and a retracting state.

The first main operation valve 61 is operated by the operating device 5. As a result of manipulation of the operating device 5, a pilot pressure acts on the first main operation valve 61, and the direction and the flow rate of hydraulic fluid supplied from the first main operation valve 61 to the bucket cylinder 21 are determined. The bucket cylinder 21 operates in a moving direction corresponding to the direction of the hydraulic fluid supplied to the bucket cylinder 21, and the bucket cylinder 21 operates at a cylinder speed corresponding to the flow rate of the hydraulic fluid supplied to the bucket cylinder 21.

Similarly, the second main operation valve 62 is operated by the operating device 5. As a result of manipulation of the operating device 5, the direction and the flow rate of hydraulic fluid supplied from the second main operation valve 62 to the arm cylinder 22 are determined. The arm cylinder 22 operates in a moving direction corresponding to the direction of the hydraulic fluid supplied to the arm cylinder 22, and the arm cylinder 22 operates at a cylinder speed corresponding to the flow rate of the hydraulic fluid supplied to the arm cylinder 22.

Similarly, the third main operation valve 63 is operated by the operating device 5. As a result of manipulation of the operating device 5, the direction and the flow rate of hydraulic fluid supplied from the third main operation valve 63 to the boom cylinder 23 are determined. The boom cylinder 23 operates in a moving direction corresponding to the direction of the hydraulic fluid supplied to the boom cylinder 23, and the boom cylinder 23 operates at a cylinder speed corresponding to the flow rate of the hydraulic fluid supplied to the boom cylinder 23.

When the bucket cylinder 21 operates, the bucket 11 is driven on the basis of the moving direction and the cylinder speed of the bucket cylinder 21. When the arm cylinder 22 operates, the arm 12 is driven on the basis of the moving direction and the cylinder speed of the arm cylinder 22. When the boom cylinder 23 operates, the boom 13 is driven on the basis of the moving direction and the cylinder speed of the boom cylinder 23.

The hydraulic fluid discharged from the bucket cylinder 21, the arm cylinder 22, and the boom cylinder 23 is discharged to a tank 54 via a discharge passage 53.

The first pump passage 41 and the second pump passage 42 are connected with each other by a merging passage 55. The merging passage 55 is a passage connecting the first hydraulic pump 31 and the second hydraulic pump 32 with each other. The merging passage 55 connects the first hydraulic pump 31 and the second hydraulic pump 32 with each other via the first pump passage 41 and the second pump passage 42.

A first merging/diverging valve 67 is provided in the merging passage 55. The first merging/diverging valve 67 is an opening/closing device provided in the merging passage 55 and configured to open and close the merging passage 55. The first merging/diverging valve 67 switches between the split-flow state in which the merging passage 55 is closed and the connected state in which the merging passage 55 is opened by closing and opening the merging passage 55. The split-flow state includes a state in which the merging passage 55 is closed so that the first pump passage 41 and the second pump passage 42 are separated from each other and hydraulic fluid discharged from the first hydraulic pump 41 and hydraulic fluid discharged from the second hydraulic pump 42 are separated from each other. The connected state includes a merging state in which the merging passage 55 is opened so that the first pump passage 41 and the second pump passage 42 are connected with each other and hydraulic fluid discharged from the first hydraulic pump 41 and hydraulic fluid discharged from the second hydraulic pump 42 merge. Note that the first merging/diverging valve 67 is a switching valve in the present embodiment, but the first merging/diverging valve 67 does not have to be a switching valve.

The merging state refers to a state in which the first pump passage 41 and the second pump passage 42 are connected with each other via the merging passage 55, and hydraulic fluid discharged from the first pump passage 41 and hydraulic fluid discharged from the second pump passage 42 merge at the first merging/diverging valve 67. The merging state is a first state in which hydraulic fluid supplied from both the first hydraulic pump 31 and the second hydraulic pump 32 is supplied to a plurality of actuators, which are the bucket cylinder 21, the arm cylinder 22, and the boom cylinder 23.

The split-flow state refers to a state in which the merging passage 55 connecting the first pump passage 41 and the second pump passage 42 with each other is separated by the first merging/diverging valve 67, and hydraulic fluid discharged from the first pump passage 41 and hydraulic fluid discharged from the second pump passage 42 are separated from each other. The split-flow state is a second state in which the actuator to which hydraulic fluid is supplied from the first hydraulic pump 31 and the actuator to which hydraulic fluid is supplied from the second hydraulic pump 32 are different. In the split-flow state, hydraulic fluid discharged from the first hydraulic pump 31 is supplied to the bucket cylinder 21 and the arm cylinder 22. Furthermore, in the split-flow state, hydraulic fluid discharged from the second hydraulic pump 32 is supplied to the boom cylinder 23.

A spool of the first merging/diverging valve 67 is movable between a merging position for opening the merging passage 55 to connect the first pump passage 41 and the second pump passage 42 with each other, and a split-flow position for closing the merging passage 55 to separate the first pump passage 41 and the second pump passage 42 from each other. The first merging/diverging valve 67 is controlled so that the first pump passage 41 and the second pump passage 42 become either one of the merging state and the split-flow state.

When the first merging/diverging valve 67 becomes a closed stated, the merging passage 55 is closed. In the split-flow state in which the merging passage 55 is closed, hydraulic fluid discharged from the first hydraulic pump 31 is supplied to a first actuator group to which at least one actuator belongs. Furthermore, in the split-flow state in which the merging passage 55 is closed, hydraulic fluid discharged from the second hydraulic pump 32 is supplied to a second actuator group to which at least one actuator different from the actuators belonging to the first actuator group belongs. In the present embodiment, among the bucket cylinder 21, the arm cylinder 22, and the boom cylinder 23, the bucket cylinder 21 and the arm cylinder 22 belong to the first actuator group. Among the bucket cylinder 21, the arm cylinder 22, and the boom cylinder 23, the boom cylinder 23 belongs to the second actuator group.

When the first merging/diverging valve 67 has become the closed state and the merging passage 55 is thus closed, hydraulic fluid discharged from the first hydraulic pump 31 is supplied to the bucket cylinder 21 and the arm cylinder 22 via the first pump passage 41, the first main operation valve 61, and the second main operation valve 62. In addition, hydraulic fluid discharged from the second hydraulic pump 32 is supplied to the boom cylinder 23 via the second pump passage 42 and the third main operation valve 63.

When the first merging/diverging valve 67 has become an open state and the merging passage 55 is thus opened, the first pump passage 41 and the second pump passage 42 are connected with each other. As a result, hydraulic fluid discharged from the first hydraulic pump 31 and the second hydraulic pump 32 is supplied to the bucket cylinder 21, the arm cylinder 22, and the boom cylinder 23 via the first pump passage 41, the second pump passage 42, the first main operation valve 61, the second main operation valve 62, and the third main operation valve 63.

The first merging/diverging valve 67 is controlled by the aforementioned pump controller 19. The pump controller 10 controls the first merging/diverging valve 67 to switch between the split-flow state in which the merging passage 55 is closed and the connected state in which the merging passage 55 is opened. In the present embodiment, the pump controller 19 is a control device for obtaining distributed flow rates of hydraulic fluid to be distributed to the respective hydraulic cylinders 20 on the basis of the operation state of the working unit 1 and the loads on the hydraulic cylinders 20, and operating the first merging/diverging valve 67 on the basis of the obtained distributed flow rates. Details of the pump controller 19 will be described later.

The hydraulic circuit 40 includes a second merging/diverging valve 68. The second merging/diverging valve 68 is connected with a shuttle valve 80 provided between the first main operation valve 61 and the second main operation valve 62. Maximum pressure of the first main operation valve 61 and the second main operation valve 62 is selected by the shuttle valve 80 and output to the second merging/diverging valve 68. In addition, the shuttle valve 80 is connected between the second merging/diverging valve 68 and the third main operation valve 63.

The second merging/diverging valve 68 selects, by the shuttle valve 80, the maximum pressure of a load sensing pressure (LS pressure) that is a reduced pressure of hydraulic fluid supplied to a first shaft representing the bucket cylinder 21, a second shaft representing the arm cylinder 22, and a third shaft representing the boom cylinder 23. The load sensing pressure refers to pilot fluid pressure used for pressure compensation. When the second merging/diverging valve 68 is in the merging state, the maximum LS pressure of the first to third shafts is selected, and supplied to respective pressure compensation valves 70 of the first to third shafts, the servomechanism 31B of the first hydraulic pump 31 and the servomechanism 32B of the second hydraulic pump 32. In contrast, when the second merging/diverging valve 68 is in the split-flow state, the maximum LS pressure of the first and second shafts is supplied to the pressure compensation valves 70 of the first and second shafts and the servomechanism 31B of the first hydraulic pump 31, and the LS pressure of the third shaft is supplied to the pressure compensation valve 70 of the third shaft and the servomechanism 32B of the second hydraulic pump 32.

The shuttle valve 80 selects a pilot fluid pressure that is the maximum value from the pilot fluid pressures output from the first main operation valve 61, the second main operation valve 62, and the third main operation valve 63. The selected pilot fluid pressure is supplied to the pressure compensation valves 70 and the servomechanisms (31B, 32B) of the hydraulic pumps 30 (31, 32).

[Pressure Sensor]

A pressure sensor 81C is attached to the first bucket passage 21A. A pressure sensor 81L is attached to the second bucket passage 21B. The pressure sensor 81C detects the pressure in the cap-side space 21C of the bucket cylinder 21. The pressure sensor 81L detects the pressure in the rod-side space 21L of the bucket cylinder 21.

A pressure sensor 82C is attached to the first arm passage 22A. A pressure sensor 82L is attached to the second arm passage 22B. The pressure sensor 82C detects the pressure in the cap-side space 22C of the arm cylinder 22. The pressure sensor 82L detects the pressure in the rod-side space 22L of the arm cylinder 22.

A pressure sensor 83C is attached to the first boom passage 23A. A pressure sensor 83L is attached to the second boom passage 23B. The pressure sensor 83C detects the pressure in the cap-side space 23C of the boom cylinder 23. The pressure sensor 83L detects the pressure in the rod-side space 21L of the boom cylinder 23.

A pressure sensor 84 is attached on a discharge port side of the first hydraulic pump 31, more specifically, between the first hydraulic pump 31 and the first pump passage 41. The pressure sensor 84 detects the pressure of hydraulic fluid discharged by the first hydraulic pump 31. A pressure sensor 85 is attached a discharge port side of the second hydraulic pump 32, more specifically, between the second hydraulic pump 32 and the second pump passage 42. The pressure sensor 85 detects the pressure of hydraulic fluid discharged by the second hydraulic pump 32. Detection values detected by the respective pressure sensors are output to the pump controller 19.

[Pressure Compensation Valve]

The hydraulic circuit 40 includes the pressure compensation valves 70. The pressure compensation valves 70 each has a selecting port for selecting between connection, throttling, and shutoff. The pressure compensation valves 70 include throttle valves capable of switching between shutoff, throttling, and connection with self-pressure. The pressure compensation valves 70 are intended to compensate flow rate distribution depending on the ratio of metering opening areas of the respective shafts even when the load pressures on the respective shafts. If the pressure compensation valves 70 are not provided, most of hydraulic fluid would flow toward a shaft with a lower load. The pressure compensation valves 70 apply a pressure drop to a shaft with a low load pressure so that the outlet pressure of a main operation valve 60 of the shaft with the low load pressure becomes equal to the outlet pressure of a main operation valve 60 of a shaft with a maximum load pressure, which results in equal outlet pressures of the respective main operation valves 60, to achieve the function of flow rate distribution.

The pressure compensation valves 70 include a pressure compensation valve 71 and a pressure compensation valve 72 that are connected with the first main operation valve 61, a pressure compensation valve 73 and a pressure compensation valve 74 that are connected with the second main operation valve 62, and a pressure compensation valve 75 and a pressure compensation valve 76 that are connected with the third main operation valve 63.

The pressure compensation valve 71 compensates for a differential pressure (metering differential pressure) across the first main operation valve 61 in a state in which the first diverging passage 47 and the first bucket passage 21A are connected with each other so that hydraulic fluid will be supplied to the cap-side space 21C. The pressure compensation valve 72 compensates for a differential pressure (metering differential pressure) across the first main operation valve 61 in a state in which the third diverging passage 49 and the second bucket passage 21B are connected with each other so that hydraulic fluid will be supplied to the rod-side space 21L.

The pressure compensation valve 73 compensates for a differential pressure (metering differential pressure) across the second main operation valve 62 in a state in which the second diverging passage 48 and the first arm passage 22A are connected with each other so that hydraulic fluid will be supplied to the rod-side space 22L. The pressure compensation valve 74 compensates for a differential pressure (metering differential pressure) across the second main operation valve 62 in a state in which the fourth diverging passage 50 and the second arm passage 22B are connected with each other so that hydraulic fluid will be supplied to the cap-side space 22C.

Note that a differential pressure (metering differential pressure) across a main operation valve refers to a difference between the pressure at an inlet port corresponding to a hydraulic pump side of the main operation valve and the pressure at an outlet port corresponding to a hydraulic cylinder side of the main operation valve, which is a differential pressure for metering a flow rate.

The pressure compensation valves 70 enable distribution of hydraulic fluid at flow rates depending on the manipulation amounts of the operating device 5 to the bucket cylinder 21 and to the arm cylinder 22 even when a low load acts on one hydraulic cylinder 20 of the bucket cylinder 21 and the arm cylinder 22 and a high load acts on the other hydraulic cylinder 20 thereof.

The pressure compensation valves 70 enable supply at flow rates based on manipulation independently of the loads on a plurality of hydraulic cylinders 20. For example, when a high load acts on the bucket cylinder 21 and a low load acts on the arm cylinder 22, the pressure compensation valves 70 (73, 74) disposed on the low load side make compensation so that the metering differential pressure AP2 on the arm cylinder 22 side, that is the low load side, becomes approximately equal to the metering differential pressure AP1 on the bucket cylinder 21 side, so that the flow rate of hydraulic fluid supplied from the second main operation valve 62 to the arm cylinder 22 will be based on the operation amount of the second main operation valve 62, independently of the metering differential pressure AP1 generated when hydraulic fluid is supplied from the first main operation valve 61 to the bucket cylinder 21.

When a high load acts on the arm cylinder 22 and a low load acts on the bucket cylinder 21, the pressure compensation valves 70 (71, 72) disposed on the low load side compensate for the metering differential pressure AP1 on the low load side, so that the flow rate of hydraulic fluid supplied from the first main operation valve 61 to the bucket cylinder 21 will be based on the operation amount of the first main operation valve 61, independently of the metering differential pressure AP2 generated when hydraulic fluid is supplied from the second main operation valve 62 to the arm cylinder 22.

[Unloader Valve]

The hydraulic circuit 40 includes unloader valves 90. In the hydraulic circuit 40, hydraulic fluid at a flow rate corresponding to a minimum capacity is discharged from the hydraulic pumps 30 even while the hydraulic cylinders 20 are not driven. The hydraulic fluid discharged from the hydraulic pumps 30 while the hydraulic cylinders 20 are not driven is unloaded via the unloader valves 90.

[Pump Controller]

Figure 4:
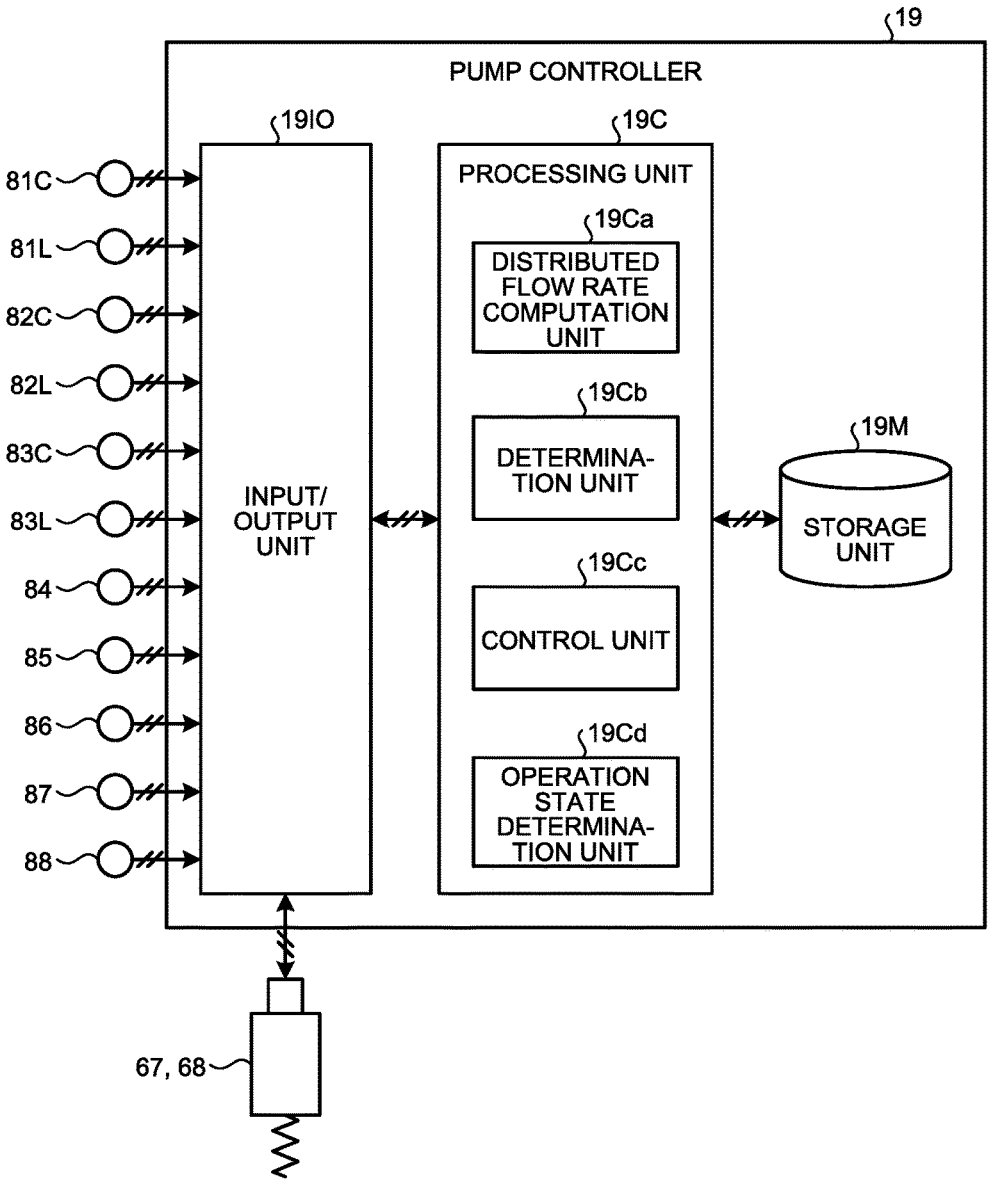
FIG. 4 is a functional block diagram of a pump controller according to the embodiment.

FIG. 4 is a functional block diagram of the pump controller 19 according to an embodiment. The pump controller 19 includes a processing unit 19C, a storage unit 19M, and an input/output unit 1910. The processing unit 19C is a processor, the storage unit 19M is a storage, and the input/output unit 1910 is an input/output interface unit. The processing unit 19C includes a distributed flow rate computation unit 19Ca, a determination unit 19Cb, a control unit 19Cc, and an operation state determination unit 19Cd. The storage unit 19M is also used as a temporary storage unit for the processing unit 19C executing processes.

The distributed flow rate computation unit 19Ca obtains distributed flow rates Q (Qbk, Qa, Qb) that are the flow rates of hydraulic fluid to be distributed to the bucket cylinder 21, the arm cylinder 22, and the boom cylinder 23. The determination unit 19Cb determines whether or not to open the first merging/diverging valve 67 on the basis of the distributed flow rates Q obtained by the distributed flow rate computation unit 19Ca. The control unit 19Cc outputs a command signal to open or close the first merging/diverging valve 67. The operation state determination unit 19Cd determines the operation state of the working unit 1 by using an input provided to the operating device 5.

The processing unit 19C, which is a processor, reads computer programs for implementing the functions of the distributed flow rate computation unit 19Ca, the determination unit 19Cb, the control unit 19Cc, and the operation state determination unit 19Cd from the storage unit 19M, and executes the computer programs. Through this processing, the functions of the distributed flow rate computation unit 19Ca, the determination unit 19Cb, the control unit 19Cc, and the operation state determination unit 19Cd are implemented. These functions may be implemented by a single circuit, a composite circuit, a programmed processor, a parallel-programmed processor, an application specific integrated circuit (ASIC), a field programmable gate array (FPGA), or a processing circuit combining some of the processors and circuits.

Pressure sensors 81C, 81L, 82C, 82L, 83C, 83L, 84, 85, 86, 87, and 88 and the first merging/diverging valve 67 are connected to the input/output unit 1910. The pressure sensors 86, 87, and 88 are pressure sensors included in the manipulation amount detection unit 28. The pressure sensor 86 detects pilot fluid pressure when an input for operating the bucket 11 is provided to the operating device 5. The pressure sensor 87 detects pilot fluid pressure when an input for operating the arm 12 is provided to the operating device 5. The pressure sensor 88 detects pilot fluid pressure when an input for operating the boom 13 is provided to the operating device 5.

The pump controller 19, or more specifically the processing unit 19C, acquires detected values of the pressure sensors 81C, 81L, 82C, 82L, 83C, 83L, 84, 85, 86, 87, and 88 from the input/output unit 1910, and uses the detected values for control to open or close the first merging/diverging valve 67, that is, for control to switch between the split-flow state and the merging state. Next, the control to open or close the first merging/diverging valve 67 will be described.

[Control to Open or Close First Merging/Diverging Valve 67]

The pump controller 19 obtains the operation state of the working unit 1 on the basis of the detected values of the pressure sensor 86,87,88 of the operating device 5. The pump controller 19 also obtains the distributed flow rates Q of hydraulic fluid to be distributed to the bucket cylinder 21, the arm cylinder 22, and the boom cylinder 23 from the detected values of the pressure sensors 81C, 81L, 82C, 82L, 83C, and 83L.

The pump controller 19 compares the obtained distributed flow rates Q with thresholds Qs of the flow rate of hydraulic fluid used for determining whether or not to make the first merging/diverging valve 67 operate, and if the distributed flow rates Q are lower than the thresholds Qs, closes the first merging/diverging valve 67 into the split-flow state. If the obtained distributed flow rates Q are higher than the thresholds Qs, the pump controller 19 opens the first merging/diverging valve 67 into the merging state. The thresholds Qs are defined on the basis of the flow rate of hydraulic fluid that the first hydraulic pump 31 alone can supply or the flow rate of hydraulic fluid that the second hydraulic pump 32 alone can supply.

When the distributed flow rates are represented by Q, the distributed flow rates are obtained by an expression (1). In the expression (1), Qd represents a required flow rate, PP represents the pressures of hydraulic fluid discharged by the hydraulic pumps 30, LA represents the loads on the hydraulic cylinders 20, and APL represents set differential pressures. In an embodiment, the first main operation valve 61, the second main operation valve 62, and the third main operation valve 63 each make the differential pressure between the inlet side and the outlet side constant. This differential pressure corresponds to the set differential pressure ΔPL, which is preset for each of the first main operation valve 61, the second main operation valve 62, and the third main operation valve 63 and stored in the storage unit 19M of the pump controller 19.

$$Q=Qd\times\sqrt{\{(PP-LA)/\Delta PL\}} \quad (1)$$

The distributed flow rate Q is determined for each of the hydraulic cylinders 20, which are the bucket cylinder 21, the arm cylinder 22, and the boom cylinder 23. When the distributed flow rate of the bucket cylinder 21 is represented by Qbk, the distributed flow rate of the arm cylinder 22 is represented by Qa, and the distributed flow rate of the boom cylinder 23 is represented by Qb, the distributed flow rates Qbk, Qa, and Qb are obtained by expressions (2) to (4).

$$Qbk=Qdbk\times\sqrt{\{(PP-LAbk)/\Delta PL\}} \quad (2)$$

$$Qa=Qda\times\sqrt{\{(PP-LAa)/\Delta PL\}} \quad (3)$$

$$Qb=Qdb\times\sqrt{\{(PP-LAb)/\Delta PL\}} \quad (4)$$

In the expression (2), Qdbk represents the required flow rate of the bucket cylinder 21, and LAbk represents the load on the bucket cylinder 21. In the expression (3), Qda represents the required flow rate of the arm cylinder 22, and LAa represents the load on the arm cylinder 22. In the expression (4), Qdb represents the required flow rate of the boom cylinder 23, and LAb represents the load on the boom cylinder 23. The set differential pressures APL are the same values for all of the first main operation valve 61 for supplying and discharging hydraulic fluid to/from the bucket cylinder 21, the second main operation valve 62 for supplying and discharging hydraulic fluid to/from the arm cylinder 22, and the third main operation valve 63 for supplying and discharging hydraulic fluid to/from the boom cylinder 23. The set differential pressures ΔPL are a set differential pressure of the first main operation valve 61 for supplying and discharging hydraulic fluid to/from the bucket cylinder 21, a set differential pressure for the second main operation valve 62 for supplying and discharging hydraulic fluid to/from the arm cylinder 22, and a set differential pressure for the third main operation valve 63 for supplying and discharging hydraulic fluid to/from the boom cylinder 23, which are all of the same values.

The required flow rates Qdbk, Qda, and Qdb are obtained on the basis of the pilot fluid pressures detected by the pressure sensor 86, 87, and 88 included in the manipulation amount detection unit 28 of the operating device 5. The pilot fluid pressures detected by the pressure sensors 86, 87, and 88 correspond to the operation state of the working unit 1. The distributed flow rate computation unit 19Ca converts the pilot fluid pressures into spool strokes of the main operation valves 60, and obtains the required flow rates Qdbk, Qda, and Qdb from the obtained spool strokes. Respective relations between the pilot fluid pressures and the spool strokes of the main operation valves 60 and respective relations between the spool strokes of the main operation valves 60 and the required flow rates Qdbk, Qda, Qdb are written in a conversion table. The conversion table is stored in the storage unit 19M. As described above, the required flow rates Qdbk, Qda, and Qdb are obtained on the basis of the operation state of the working unit 1.

The distributed flow rate computation unit 19Ca acquires a detected value of the pressure sensor 86 for detecting a pilot fluid pressure associated with the operation of the bucket 11, and converts the detected value into the spool stroke of the first main operation valve 61. The distributed flow rate computation unit 19Ca then obtains the required flow rate Qdbk of the bucket cylinder 21 from the obtained spool stroke.

The distributed flow rate computation unit 19Ca acquires a detected value of the pressure sensor 87 for detecting the pilot fluid pressure associated with the operation of the arm 12, and converts the detected value into the spool stroke of the second main operation valve 62. The distributed flow rate computation unit 19Ca then obtains the required flow rate Qda of the arm cylinder 22 from the obtained spool stroke.

The distributed flow rate computation unit 19Ca acquires a detected value of the pressure sensor 88 for detecting the pilot fluid pressure associated with the operation of the boom 13, and converts the detected value into the spool strake of the third main operation valve 63. The distributed flow rate computation unit 19Ca then obtains the required flow rate Qdb of the boom cylinder 23 from the obtained spool stroke.

The directions in which the bucket 11, the arm 12, and the boom 13 operate vary depending on the directions in which the spools of the first main operation valve 61, the second main operation valve 62, and the third main operation valve 63 stroke. The distributed flow rate computation unit 19Ca selects which of the pressures in the cap-side spaces 21C, 22C, and 23C and the pressures in the rod-side spaces 21L, 22L, and 23L to use for obtaining the loads LA depending on the directions in which the bucket 11, the arm 12, and the boom 13 operate. For example, when the spool strokes are in a first direction, the distributed flow rate computation unit 19Ca obtains the loads LAbk,LAa, and LAb by using detected values of the pressure sensors 81C, 82C, and 83C for detecting the pressures in the cap-side spaces 21C, 22C, and 23C. When the spool strokes are in a second direction opposite to the first direction, the distributed flow rate computation unit 19Ca obtains the loads LA, LAa, and LAb by using detected values of the pressure sensors 81L, 82L, and 83L for detecting the pressures in the rod-side spaces 21L, 22L, and 23L. In the embodiment, the loads LA, LAa, and LAb represent the pressure in the bucket cylinder 21, the pressure in the arm cylinder 22, and the pressure in the boom cylinder 23, respectively.

In the expressions (1) to (4), the pressures PP of hydraulic fluid discharged by the hydraulic pumps 30 are unknown. The distributed flow rate computation unit 19Ca repeats numerical calculation so that the following expression (5) converges, and makes the first merging/diverging valve 67 operate on the basis of the distributed flow rates Qbk, Qa, and Qb when the expression (5) converges.

$$Qlp=Qbk+Qa+Qb \tag{5}$$

Qlp represents a pump limit flow rate, which is the smallest value of the pump maximum flow rate Qmax and a pump target flow rate Qt determined from a target output of the first hydraulic pump 31 and the second hydraulic pump 32. The pump maximum flow rate Qmax is a value obtained by subtracting the flow rate of hydraulic fluid supplied to a hydraulic swing motor when the electric swing motor 25 is replaced by the hydraulic swing motor from a flow rate obtained from an indicated value of the throttle dial 33. When the excavator 100 does not include the electric swing motor 25, the pump maximum flow rate Qmax is the flow rate obtained from the indicated value of the throttle dial 33.

The target output of the first hydraulic pump 31 and the second hydraulic pump 32 is values obtained by subtracting an output of an auxiliary machine of the excavator 100 from a target output of the engine 26. The pump target flow rate Qt is a flow rate obtained from the target output of the first hydraulic pump 31 and the second hydraulic pump 32 and pump pressure. Specifically, the pump pressure is the higher of the pressure of hydraulic fluid discharged by the first hydraulic pump 31 and the pressure of hydraulic fluid discharged by the second hydraulic pump 32.

After the distributed flow rates Qbk, Qa, and Qb are obtained, the determination unit 19Cb of the pump controller 19 determines whether to switch the state to the merging state or the split-flow state on the basis of the result of comparison between the distributed flow rates Qbk, Qa, and Qb and the thresholds Qs. The control unit 19Cc makes the first merging/diverging valve 67 operate on the basis of the merging state or the split-flow state determined by the determination unit 19Cb. The thresholds Qs are determined on the basis of a first supply flow rate Qsf indicating the flow rate of hydraulic fluid that can be supplied by the first hydraulic pump 31 alone and a second supply flow rate Qss indicating the flow rate of hydraulic fluid that can by supplied by the second hydraulic pump 32 alone.

The first supply flow rate Qsf indicating the flow rate of hydraulic fluid that can be supplied by the first hydraulic pump 31 alone is obtained by multiplying the maximum capacity of the first hydraulic pump 31 by the maximum engine speed of the engine 26 determined by the indicated value of the throttle dial 33. The second supply flow rate Qss indicating the flow rate of hydraulic fluid that can be supplied by the second hydraulic pump 32 alone is obtained by multiplying the maximum capacity of the second hydraulic pump 32 by the maximum engine speed of the engine 26 determined by the indicated value of the throttle dial 33. Since the first hydraulic pump 31 and the second hydraulic pump 32 are directly connected to the output shaft of the engine 26, the rotation speeds of the first hydraulic pump 31 and the second hydraulic pump 32 are equal to the engine speed of the engine 26. In the present embodiment, the thresholds Qs of hydraulic fluid used for determining whether or not to make the first merging/diverging valve 67 operate are the first supply flow rate Qsf and the second supply flow rate Qss.

The first hydraulic pump 31 supplies hydraulic fluid to the bucket cylinder 21 and the arm cylinder 22. Thus, if the sum of the distributed flow rate Qbk of the bucket cylinder 21 and the distributed flow rate Qa of the arm cylinder 22 is the first supply flow rate Qsf or lower, the first hydraulic pump 31 alone can supply hydraulic fluid to the bucket cylinder 21 and the arm cylinder 22. The second hydraulic pump 32 supplies hydraulic fluid to the boom cylinder 23. Thus, if the distributed flow rate Qb of the boom cylinder 23 is the second supply flow rate Qss or lower, the second hydraulic pump 32 alone can supply hydraulic fluid to the boom cylinder 23.

If the sum of the distributed flow rate Qbk of the bucket cylinder 21 and the distributed flow rate Qa of the arm cylinder 22 is the first supply flow rate Qsf or lower and the distributed flow rate Qb of the boom cylinder 23 is the second supply flow rate Qss or lower, the determination unit 19Cb determines the state to be the split-flow state. In this case, the determination unit 19Cb closes the first merging/diverging valve 67. If the sum of the distributed flow rate Qbk of the bucket cylinder 21 and the distributed flow rate Qa of the arm cylinder 22 is not the first supply flow rate Qsf or lower or if the distributed flow rate Qb of the boom cylinder 23 is not the second supply flow rate Qss or lower, the determination unit 19Cb determines the state to be the merging state. In this case, the determination unit 19Cb opens the first merging/diverging valve 67. The determination on the switching between the split flow and the merging performed by the determination unit 19Cb may be based on the difference between the pressures of the first pump 31 and the second pump 32 (the pressure sensors 84 and 85) instead of the distributed flow rates.

Figure 5:
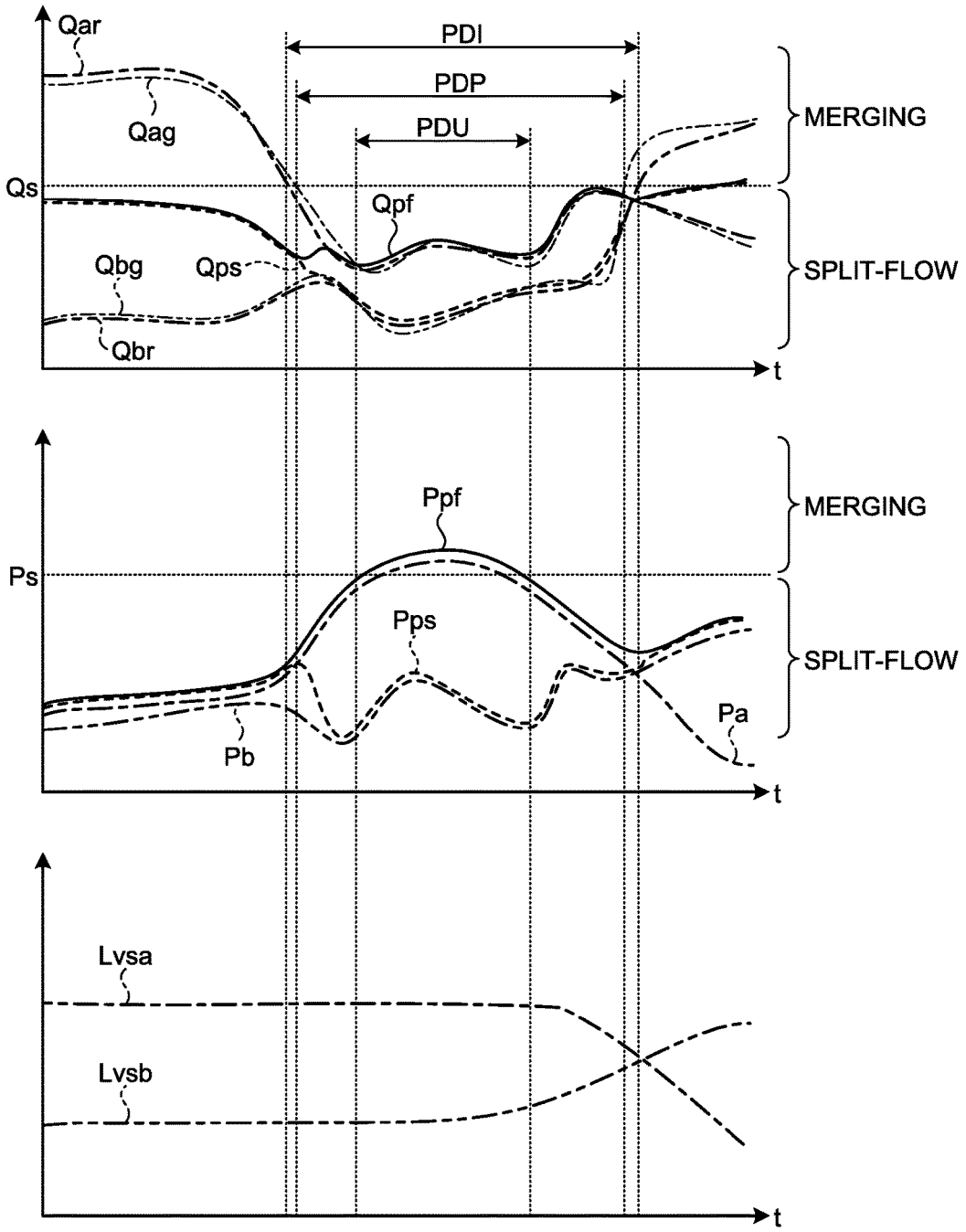
FIG. 5 illustrates graphs showing one example of the flow rates of pumps and hydraulic cylinders, the discharge pressures of the pumps, and lever strokes, which change with time.

FIG. 5 illustrates graphs showing one example of the flow rates of the pumps and the hydraulic cylinders, the discharge pressures of the pumps, and lever strokes, which change with time t. The horizontal axes in FIG. 5 represent time t. An estimated value of the flow rate of hydraulic fluid to be supplied to the arm cylinder 22 is represented by Qag, an estimated value of the flow rate of hydraulic fluid to be supplied to the boom cylinder 23 is represented by Qbg, and a true value of the flow rate of hydraulic fluid supplied to the arm cylinder 22 is represented by Qar, and a true value of the flow rate of hydraulic fluid supplied to the boom cylinder 23 is represented by Qbr. The estimated value Qag is the distributed flow rate Qa of the arm cylinder 22 obtained by the pump controller 19, and the estimated value Qbg is the distributed flow rate Qb of the boom cylinder 23 obtained by the pump controller 19.

A flow rate Qpf represents the flow rate of hydraulic fluid discharged by the first hydraulic pump 31, and a flow rate Qps represents the flow rate of hydraulic fluid discharged by the second hydraulic pump 32. A pressure Ppf represents the pressure of hydraulic fluid discharged by the first hydraulic pump 31, and a pressure Pps represents the pressure of hydraulic fluid discharged by the second hydraulic pump 32. A pressure Pa represents the pressure of hydraulic fluid supplied to the arm cylinder 22, and a pressure Pb represents the pressure of hydraulic fluid supplied to the boom cylinder 23. A lever stroke Lvsa represents the stroke of the control lever when the operating device 5 is manipulated to operate the arm 12. A lever stroke Lvsb represents the stroke of the control lever when the operating device 5 is manipulated to operate the boom 13.

In the present embodiment, the pump controller 19 obtains the distributed flow rates Q of hydraulic fluid distributed to the respective hydraulic cylinders 20, which are actuators for driving the working unit 1, on the basis of the operation state of the working unit 1 and the loads on the hydraulic cylinders 20. The pump controller 19 then switches between the merging state and the split-flow state on the basis of the obtained distributed flow rates Q and the thresholds Qs. In the present embodiment, the period during which the state can be the split-flow state is a period PDP.

In contrast, there is a method of switching between the merging state and the split-flow state on the basis of the pressure Ppf of hydraulic fluid discharged by the first hydraulic pump 31 and the pressure Pps of hydraulic fluid discharged by the second hydraulic pump 32. According to this method, for example, the state is to be the split-flow state if the pressures Ppf and Pps are thresholds Ps or higher since the flow rates of hydraulic fluid required for the hydraulic cylinders 20 are low, and the state is to be the merging state if the pressures Ppf and Pps are lower than the thresholds Ps since the flow rates of hydraulic fluid required for the hydraulic cylinders 20 are high. Since it is difficult to accurately estimate the flow rates of hydraulic fluid to be supplied to the hydraulic cylinders 20 on the basis of the pressures Ppf and Pps, the thresholds Ps need to be high. In this case, the period during which the state can be the split-flow state is a period PDU.

A period PDI during which the state can be the split-flow state is a period obtained on the basis of the true values Qar and Qbr of the flow rates of hydraulic fluid supplied to the hydraulic cylinders 20 and the thresholds Qs. The true values Qar and Qbr of the flow rates of hydraulic fluid supplied to the hydraulic cylinders 20 cannot be actually obtained, but the period PDI based on the true values Qar and Qbr is a period that is the longest possible period in theory.

As can be seen in FIG. 5, the period during which the state can be the split-flow state is the period PDU based on the pressures Ppf and Pps, the period PDP determined by the control system 9 including the pump controller 19, and the period PDI based on the true values Qar and Qbr in ascending order of length. In this manner, the control system 9 is capable of making the period PDP during which the state can be the split-flow state closer to the theoretically possible period, that is, the period PDI based on the true values Qar and Qbr of the flow rates of hydraulic fluid supplied to the hydraulic cylinders 20. As a result, since the control system 9 is able to make the period during which the drive 4 operates in the split-flow state longer, the period during which the pressure of high-pressure hydraulic fluid is reduced so that the pressure drop during supply to the boom cylinder 23 is reduced in the merging state is longer.

[Processing of Control Unit 19Cc]

The control unit 19Cc controls the first merging/diverging valve 67 to switch between the split-flow state in which the merging passage 55 is closed and the merging state in which the merging passage 55 is opened. In the split-flow state, hydraulic fluid discharged from the first hydraulic pump 31 is supplied to the arm cylinder 22 and the bucket cylinder 23 in the first actuator group. In addition, in the split-flow state, hydraulic fluid discharged from the second hydraulic pump 32 is supplied to the boom cylinder 23 of the second actuator group.

The hydraulic cylinders 20 is operated by the manipulation of the operating device 5. The control unit 19Cc controls the first merging/diverging valve 67 to maintain the merging state when either one of the first actuator group and the second actuator group is brought into an operated state by the operating device 5 in the merging state, and to maintain the split-flow state when either one of the first actuator group and the second actuator group is brought into a non-operated state by the operating device 5 in the split-flow state.

[Unloading Flow Rate]

As described above, the hydraulic circuit 40 includes the unloader valves 90. For example, when the arm cylinder 22 is operated by the operating device 5 and the boom cylinder 23 is not operated by the operating device 5 in the split-flow state, that is, when the first actuator group connected to the first hydraulic pump 31 is driven and the second actuator group connected to the second hydraulic pump 32 is not driven in the split-flow state, hydraulic fluid discharged from the second hydraulic pump 32 will be unloaded via the unloader valve 90. A large amount of unloaded hydraulic fluid means that the hydraulic pump 30 is wastefully driven, which leads to lower fuel efficiency of the excavator 100, for example.

Figure 6:
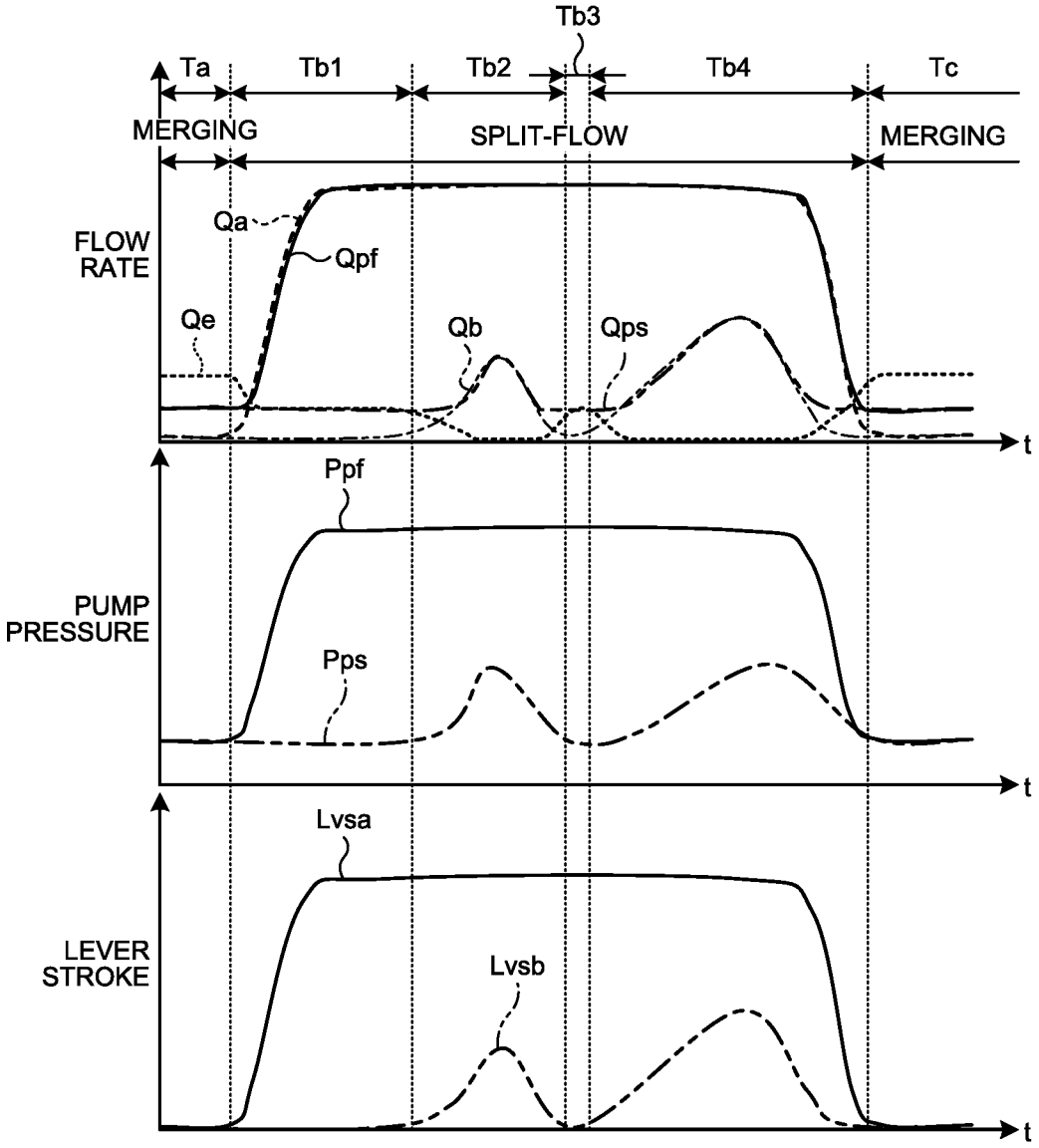
FIG. 6 illustrates graphs showing one example of changes of distributed flow rates, modified distributed flow rates, and true values of the flow rates of hydraulic fluid supplied to hydraulic cylinders with time.

FIG. 6 illustrates graphs showing one example of the flow rates of hydraulic pumps 30 and the hydraulic cylinders 20, the discharge pressures of the hydraulic pumps 30, and lever strokes indicating the manipulation amount of the operating device 5, which change with time. Note that in the description below, for ease of explanation, an example in which a first hydraulic cylinder group is constituted by the arm cylinder 22 alone and the second hydraulic cylinder group is constituted by the boom cylinder 23 alone will be described.

In the graphs illustrated in FIG. 6, the horizontal axes represent time t. A solid line Qpf represents the pump flow rate of the first hydraulic pump 31, a solid line Qps represents the pump flow rate of the second hydraulic pump 32. A dotted line Qa represents a flow rate Qa required by the arm cylinder 22, and a dotted line Qb represents a flow rate Qb required by the boom cylinder 23. In addition, a dotted line Qe represents an unloading flow rate Qe.

FIG. 6 illustrates an example in which a manipulation lever (hereinafter referred to as an arm lever) of the operating device 5 is manipulated to drive the arm 12, and a manipulation lever (hereinafter referred to as a boom lever) of the operating device 5 for operating the boom 13 is intermittently manipulated. During a period Ta, in the merging state, the arm lever and the boom lever are not manipulated. In this case, the flow rate Qa and the flow rate Qb are zero. In the meantime, hydraulic fluid is slightly discharged from each of the first hydraulic pump 31 and the second hydraulic pump 32. In this case, hydraulic fluid is unloaded at a constant unloading flow rate QeQb. The unloading flow rate Qe in this case is a sum of the flow rate Qpf and the flow rate Qps.

During a period Tb1 in the split-flow state, the arm lever is manipulated at a lever stroke Lvsa, and the boom lever is not manipulated. Since the state is the split-flow state, the manipulation of the arm lever increases the pump pressure Ppf of the first hydraulic pump 31, and hydraulic fluid is then discharged from the first hydraulic pump 31 at a flow rate Qpf based on the lever stroke Lvsa. The hydraulic fluid discharged from the first hydraulic pump 31 is supplied to the arm cylinder 22 and is thus not unloaded. Since the boom lever is not manipulated, the pump pressure Pps of the second hydraulic pump 32 does not increase. In this case, hydraulic fluid discharged from the second hydraulic pump 32 is unloaded. The unloading flow rate Qe in this case is equal to the flow rate Qps.

During a period Tb2 in the split-flow state, when the boom lever is also operated in addition to the arm lever, the pump pressure Pps of the second hydraulic pump 32 increases, and hydraulic fluid is discharged from the second hydraulic pump 32 at a flow rate Qps based on the lever stroke Lvsb of the boom lever. The hydraulic fluid discharged from the second hydraulic pump 32 is supplied to the boom cylinder 23 and is thus not unloaded. The unloading flow rate Qe in this case is zero.

During a period Tb3 in the split-flow state, when the boom lever is returned to its neutral position, the pump pressure Pps of the second hydraulic pump 32 lowers. Even when the pump pressure Pps has lowered, hydraulic fluid is slightly discharged from the second hydraulic pump 32 and unloaded. The unloading flow rate Qe in this case is equal to the flow rate Qps.

During a period Tb4 in the split-flow state, when the boom lever is also operated in addition to the arm lever, the pump pressure Pps of the second hydraulic pump 32 increases, and hydraulic fluid is discharged from the second hydraulic pump 32 at a flow rate Qps based on the lever stroke Lvsb of the boom lever. The hydraulic fluid discharged from the second hydraulic pump 32 is supplied to the boom cylinder 23 and is thus not unloaded. The unloading flow rate Qe in this case is zero.

As described above, when manipulation of either one manipulation lever on the arm lever and the boom lever in the split-flow state is released, unloaded hydraulic fluid is present. A large amount of unloading flow rate Qe means that the hydraulic pumps 30 are wastefully operated, which leads to lower fuel efficiency of the excavator 100, for example.

In the present embodiment, when the state has once become the merging state, either one of the first actuator group and the second actuator group is driven even if the condition for the split-flow state is satisfied in the determination on whether the condition for the split-flow state is satisfied, and the determination unit 19Cb determines the state to be the merging state even when the other actuator group is not driven. Thus, when the state has once become the merging state, the determination unit 19Cb maintains the merging state if either one manipulation lever of a first manipulation lever for operating the first actuator group, and a second manipulation lever for operating the second actuator group is manipulated and the other manipulation lever is not manipulated, even if the distributed flow rates Q (distributed flow rates Qbk, Qa, and Qb) of the respective working unit components are the thresholds Qs (Qsf, Qss) or lower.

[Control Method]

Figure 7:
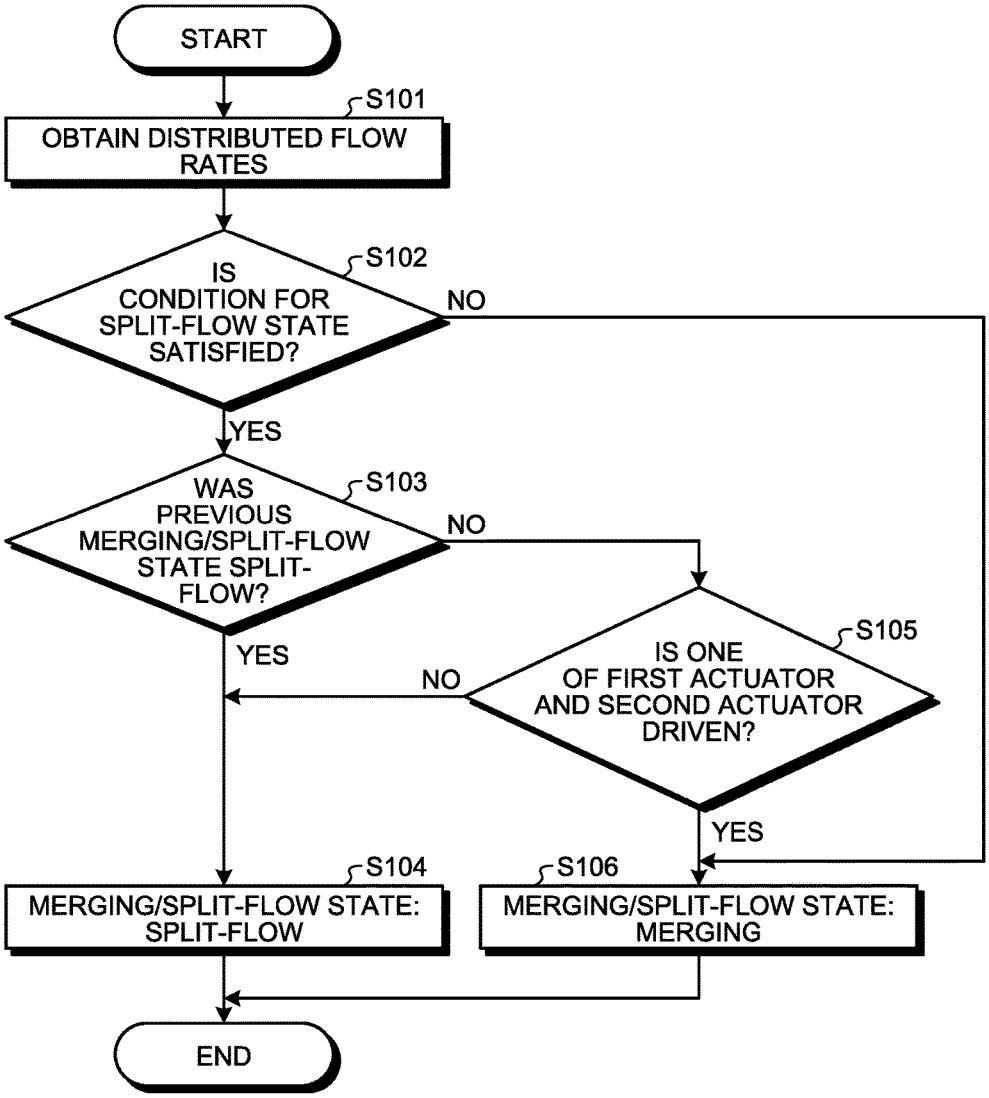
FIG. 7 is a flowchart illustrating one example of a control method according to the embodiment.

Next, a method for controlling the excavator 100 according to the present embodiment will be explained. FIG. 7 is a flowchart illustrating one example of the method for controlling the excavator 100 according to the present embodiment. The control method according to the present embodiment includes obtaining the distributed flow rates Q of hydraulic fluid distributed to the respective hydraulic cylinders 20, which are actuators for driving the working unit 1, on the basis of the operation state of the working unit 1 and the loads on the hydraulic cylinders 20, and switching between the merging state and the split-flow state on the basis of the obtained distributed flow rates Q and the thresholds Qs. The control method according to the present embodiment is implemented by the control system 9, or more specifically the pump controller 19.

The distributed flow rate computation unit 19Ca of the pump controller 19 obtains the distributed flow rates Qbk, Qa, and Qb (step S101).

In step S102, the determination unit 19Cb of the pump controller 19 determines whether or not a condition for the split-flow state is satisfied (step S102).

If it is determined in step S102 that the condition for the split-flow state is satisfied (step S102: Yes), the determination unit 19Cb determines whether or not the previous merging/split-flow state of the first hydraulic pump 31 and the second hydraulic pump 32 was the split-flow state (step S103).

If it is determined in step S103, that the previous merging/split-flow state was the split-flow state (step S103: Yes), the determination unit 19Cb determines the merging/split-flow state to be the split-flow state. If it is determined by the determination unit 19Cb to bring the state into the split-flow state, the control unit 19Cc closes the first merging/diverging valve 67 to set the split-flow state (step S104). As a result of this processing, the drive 4 operates in the split-flow state.

If it is determined in step S102 that the condition for the split-flow state is not satisfied (step S102: No), the determination unit 19Cb determines the merging/split-flow state to be the merging state. If it is determined by the determination unit 19Cb to bring the state into the merging state, the control unit 19Cc opens the first merging/diverging valve 67 to set the merging state (step S106). As a result of this processing, the drive 4 operates in the merging state.

If it is determined in step S103 that the previous merging/split-flow state was not the split-flow state (step S103: No), the determination unit 19Cb determines whether or not either one of the first actuator group and the second actuator group is in a driven state (step S105).

If it is determined in step S105 that both of the first actuator group and the second actuator group are in a non-driven state in which the actuator groups are not driven (step S105: No), the determination unit 19Cb determines the merging/split-flow state to be the split-flow state. The control unit 19Cc closes the first merging/diverging valve 67 to set the split-flow state (step S104).

If it is determined in step S105 that either one of the first actuator group and the second actuator group is in a driven state in which the actuator group is driven (step S105: Yes), the determination unit 19Cb determines the merging/split-flow state to be the merging state. The control unit 19Cc opens the first merging/diverging valve 67 to set the merging state (step S106).

As described above, in the present embodiment, the control unit 19Cc also sets the first merging/diverging valve 67 in the connected state so that the merging state of the first hydraulic pump 31 and the second hydraulic pump 32 is maintained (step S106) if the previous merging/split-flow state is determined to be the merging state (step S103: No) and it is determined by the determination unit 19Cb that either one of the first actuator group and the second actuator group is in the driven state in the merging state of the first hydraulic pump 31 and the second hydraulic pump 32 (step S105: Yes).

Thus, in the present embodiment, when the state has once become the merging state, if either one of the first actuator group and the second actuator group is in the driven state even if the condition for the split-flow state is satisfied in the determination on whether the condition for the split-flow state is satisfied, the determination unit 19Cb maintains the determination of the merging state and the control unit 19Cc controls first merging/diverging valve 67.

Figure 8:
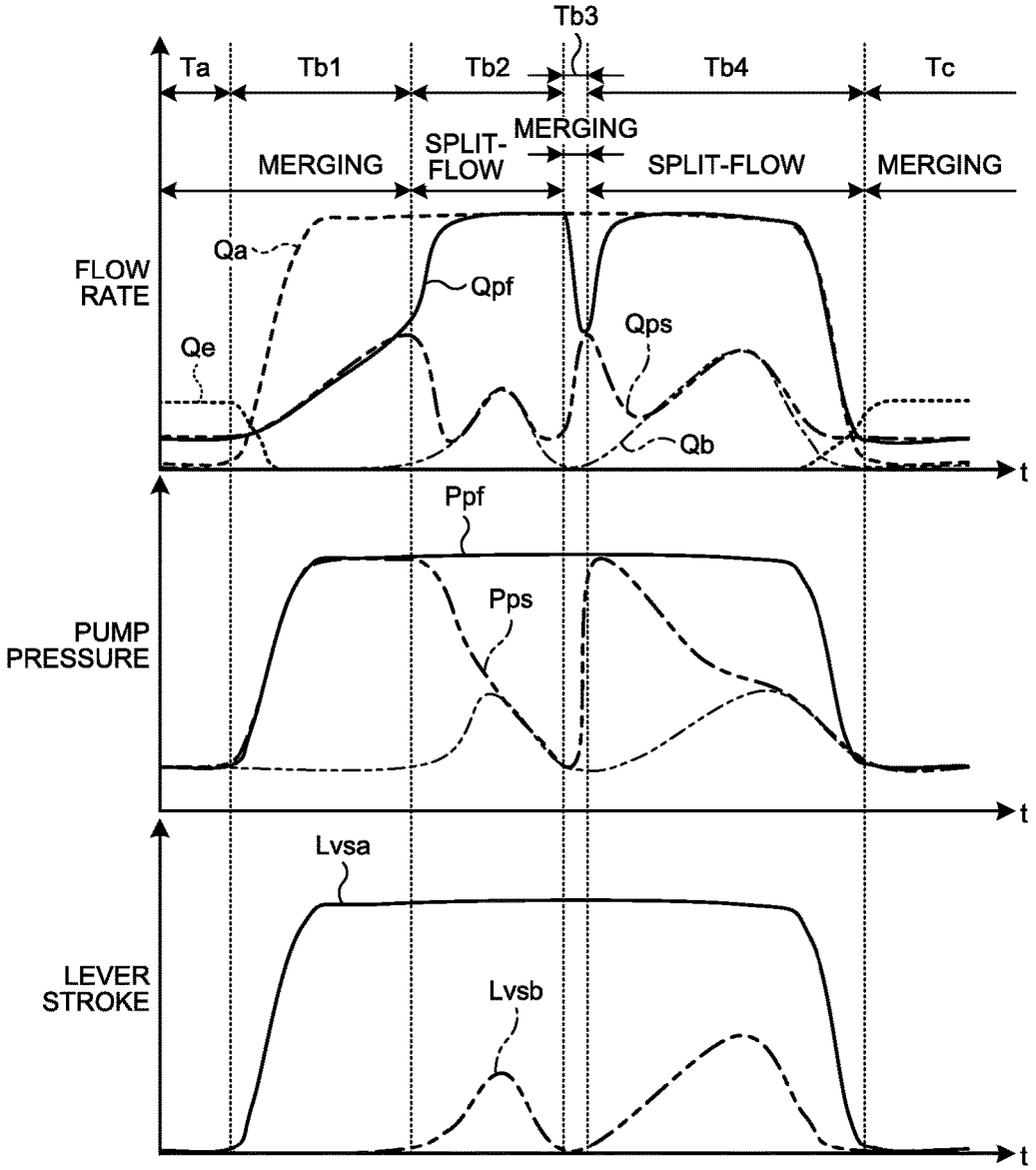
FIG. 8 illustrates graphs showing one example of the flow rates of hydraulic pumps and hydraulic cylinders, the pump pressures of the hydraulic pumps, and lever strokes indicating the manipulation amount of the operating device, which change with time.

FIG. 8 illustrates graphs showing one example of the flow rates of the hydraulic pumps 30 and the hydraulic cylinders 20, the pump pressures of the hydraulic pumps 30, and lever strokes indicating the manipulation amount of the operating device 5, which change with time. As illustrated in FIG. 8, a period Ta is a period during which neither of the boom lever and the arm lever is manipulated. During the period Ta, the merging state is set. Periods Tb1 and Tb3 are periods during which the arm lever is manipulated and the boom lever is not manipulated. During the periods Tb1 and Tb3, the merging state is maintained. Specifically, the control unit 19Cc controls the first merging/diverging valve 67 so that the merging state is maintained in the period Tb1 even when at least one of the arm lever and the boom lever is in the manipulated state during the period Ta in the merging state and either one of the first actuator group and the second actuator group is in the driven state. Thus, hydraulic fluid discharged from the second hydraulic pump 32 is not unloaded but supplied to the arm cylinder 22 for contribution to the driving of the arm cylinder 22. Note that, during the periods Tb1 and Tb3, the flow rate Qa of hydraulic fluid supplied to the arm cylinder 22 corresponds to the sum of the flow rate Qpf and the flow rate Qps.

During periods Tb2 and Tb4, since both of the arm lever and the boom lever are manipulated, no unloaded hydraulic fluid is present even in the split-flow state.

In the meantime, since the period Tb3 illustrated in FIG. 8 is in the merging state, when the state changes from the split-flow state in the period Tb2 to the merging state in the period Tb3, the pump pressure Pps of the second hydraulic pump 32 rises sharply to be equal to the pump pressure Ppf. Thereafter, when the state changes from the merging state in the period Tb3 to the split-flow state in the period Tb4, the pump pressure Pps does not immediately lower. Thus, pressure loss caused by the changes from the split-flow state to the merging state and to the split-flow state again is generated. Specifically, if control to set the merging state when either one of the arm lever and the boom lever is in the non-operated state and to set the split-flow state when both of the arm lever and the boom lever are in the operated state is strictly performed, the switching between the merging state and the split-flow state occurs frequently in a very short time, which causes pressure loss.

Thus, even when a change from a state in which both of the arm lever and the boom lever are operated in the split-flow state to a state in which either one of the arm lever and the boom lever becomes non-operated, the control unit 19Cc maintains the split-flow state. Specifically, the control unit 19Cc controls the first merging/diverging valve 67 so that the split-flow state is maintained during the period Tb3 even when either one of the arm lever and the boom lever becomes in the non-operated state and either one of the first actuator group and the second actuator group becomes the non-driven state during the period Tb in the split-flow state.

Figure 9:
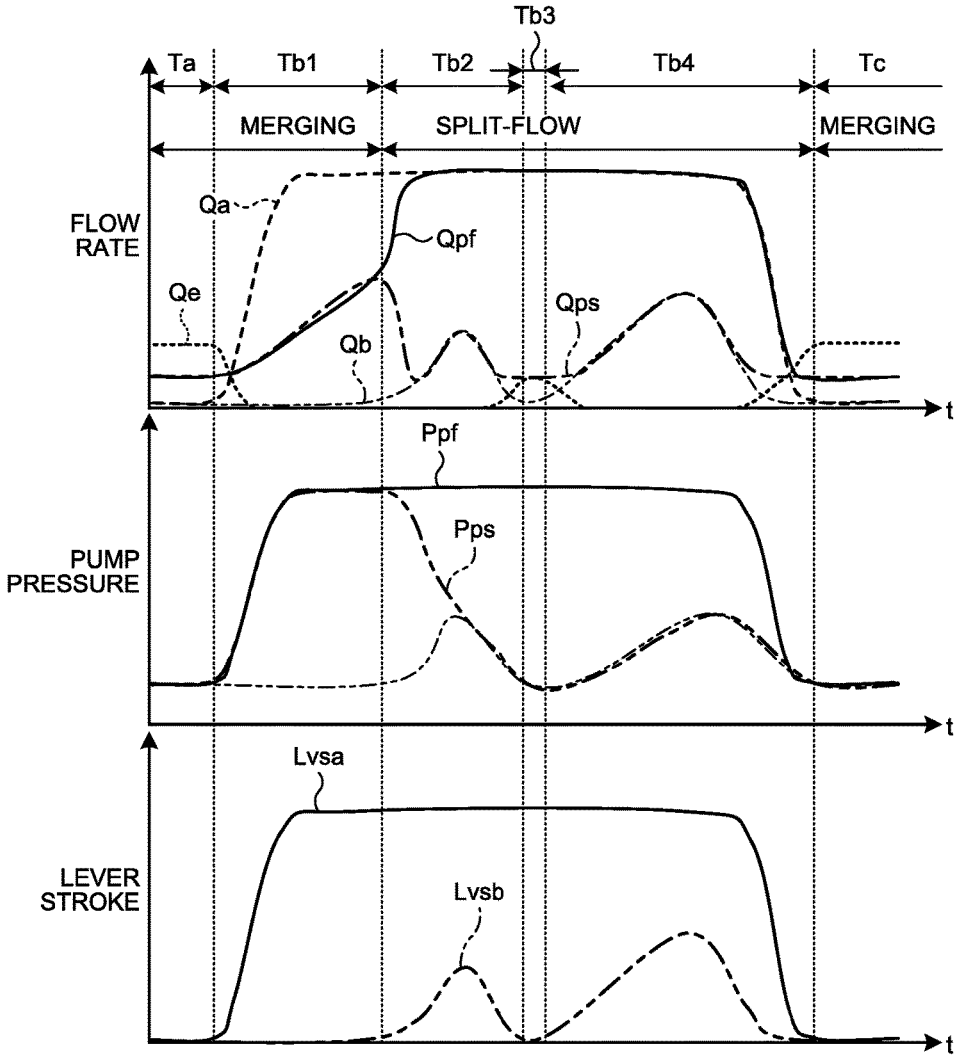
FIG. 9 illustrates graphs showing one example of the flow rates of the hydraulic pumps and the hydraulic cylinders, the pump pressures of the hydraulic pumps, and the lever strokes indicating the manipulation amount of the operating device, which change with time.

FIG. 9 illustrates graphs showing one example of the flow rates of the hydraulic pumps 30 and the hydraulic cylinders 20, the pump pressures of the hydraulic pumps 20, and lever strokes indicating the manipulation amount of the operating device 5, which change with time. As illustrated in FIG. 9, the period Tb2 is in a split-flow state. During the period Tb2, both of the arm lever and the boom lever are manipulated. Even if the boom lever is changed from this state to the non-operated state, the split-flow state is maintained during the period Tb3. During the period Tb3, although unloaded hydraulic fluid is present, sharp change in the pump pressure Pps is prevented. Occurrence of pressure loss is thus prevented.

Specifically, in the example illustrated in FIG. 9, even when one of the first actuator group and the second actuator group is brought into the non-operated state in the split-flow state, the split-flow state is maintained, and hydraulic fluid discharged from a hydraulic pump 30 of either one of the first hydraulic pump 31 and the second hydraulic pump 32 is supplied to the actuator group in the driven state (the first actuator group in the example illustrated in FIG. 9).

As described above, according to the present embodiment, the merging passage 55 connecting the first hydraulic pump 31 and the second hydraulic pump 32 with each other is switched between the split-flow state and the merging state by the first merging/diverging valve 67. Even if either one of the first actuator group and the second actuator group is brought into the driven state and the condition for the split-flow state is satisfied in the determination on whether the condition for the split-flow state is satisfied in the merging state, the control unit 19Cc controls the first merging/diverging valve 67 so that the merging state is maintained. Thus, hydraulic fluid unloaded via the unloader valves 90 is reduced. Accordingly, decrease in the fuel efficiency of the excavator 100 is prevented.

Furthermore, according to the present embodiment, even if either one of the first actuator group and the second actuator group is brought into the non-driven state in the split-flow state, the control unit 19Cc controls the first merging/diverging valve 19Cc so that the split-flow state is maintained. Thus hydraulic fluid unloaded via the unloader valves 90 is reduced and Occurrence of pressure loss is prevented.

Furthermore, according to the present embodiment, switching between the merging state and the split-flow state is performed according to the manipulation of the operating device 5. Thus, according to the manipulation of the operating device 5, the control unit 19Cc is capable of maintaining the merging state if either one of the first actuator group and the second actuator group is brought into the operated state by the operating device 5 in the merging state, and maintaining the split-flow state if either one of the first actuator group and the second actuator group is brought into the non-operated state by the operating device 5 in the split-flow state.

Note that, in the present embodiment, the drive 4 (hydraulic circuit 40) is applied to the excavator 100. The application of the drive 4, however, is not limited to excavators, but the drive 4 is also widely applicable to a hydraulically-driven work machine other than excavators.

Note that the excavator 100, which is the work machine is hybrid equipment in the present embodiment, but the work machine does not have to be hybrid. Note that the first hydraulic pump 31 and the second hydraulic pump 32 are swash plate pumps in the present embodiment, but the pumps are not limited thereto. Note that the loads LA, LAa, and LAb are the pressure in the bucket cylinder 21, the pressure in the arm cylinder 22, and the pressure in the boom cylinder 23, respectively, in the present embodiment, but the loads are not limited thereto. For example, the loads LA, LAa, and LAb may be the pressure in the bucket cylinder 21, the pressure in the arm cylinder 22, and the pressure in the boom cylinder 23, which have been corrected on the basis of the ratio of areas of throttle valves included in the pressure compensation valves 71 to 76.

Note that the thresholds Qs used in determining whether or not to make the first merging/diverging valve 67 operate are the first supply flow rate Qsf and the second supply flow rate Qss in the present embodiment, the thresholds are not limited thereto. For example, the thresholds Qs may be flow rates lower than the first supply flow rate Qsf and the second supply flow rate Qss.

While the present embodiments has been described above, the present embodiment is not limited to the description of the present embodiment. Components described in the present embodiment include those easily conceivable by those skilled in the art, those which are substantially the same, and so-called their equivalents. Components described in the present embodiment can be combined as appropriate. Furthermore, at least one of various omissions, replacements and modifications of the components is possible without departing from the scope of the present embodiment.

REFERENCE SIGNS LIST

1 WORKING UNIT
2 UPPER SWING STRUCTURE
3 LOWER TRAVELING STRUCTURE
4 DRIVE
5 OPERATING DEVICE
9 CONTROL SYSTEM
11 BUCKET
12 ARM
13 BOOM
14 STORAGE BATTERY
17 HYBRID CONTROLLER
18 ENGINE CONTROLLER
19 PUMP CONTROLLER
19C PROCESSING UNIT
19M STORAGE UNIT
19Ca DISTRIBUTED FLOW RATE COMPUTATION UNIT
19Cb DETERMINATION UNIT
19Cc CONTROL UNIT
19Cd OPERATION STATE DETERMINATION UNIT
19IO INPUT/OUTPUT UNIT
20 HYDRAULIC CYLINDER
21 BUCKET CYLINDER
22 ARM CYLINDER
23 BOOM CYLINDER
24 TRAVEL MOTOR
25 ELECTRIC SWING MOTOR
26 ENGINE
28 MANIPULATION AMOUNT DETECTION UNIT
29 COMMON RAIL CONTROL UNIT
30 HYDRAULIC PUMP
31 FIRST HYDRAULIC PUMP
32 SECOND HYDRAULIC PUMP
33 THROTTLE DIAL
40 HYDRAULIC CIRCUIT
55 MERGING PASSAGE
60 MAIN OPERATION VALVE
61 FIRST MAIN OPERATION VALVE
62 SECOND MAIN OPERATION VALVE
63 THIRD MAIN OPERATION VALVE
67 FIRST MERGING/DIVERGING VALVE
68 SECOND MERGING/DIVERGING VALVE
81C, 81L, 82C, 82L, 83C, 83L, 84, 85, 86, 87, 88 PRESSURE SENSOR
100 EXCAVATOR (WORK MACHINE)
LA, LAa, LAb, LAbk LOAD
Q, Qa, Qb, Qbk DISTRIBUTED FLOW RATE
Qs THRESHOLD

The invention claimed is:

1. A control system configured to control a work machine including a working unit having a plurality of working unit components, and a plurality of actuators configured to drive the respective working unit components, the control system, components and actuators comprising:

a first hydraulic pump and a second hydraulic pump;

a passage connecting the first hydraulic pump and the second hydraulic pump with each other;

an opening/closing device provided in the passage and configured to open and close the passage;

a control device configured to control the opening/closing device to switch between a split-flow state in which the passage is closed and a connected state in which the passage is open;

a first actuator, one of the plurality of actuators, to which hydraulic fluid discharged from the first hydraulic pump is supplied in the split-flow state; and a second actuator, one of the plurality of actuators, to which hydraulic fluid discharged from the second hydraulic pump is supplied in the split-flow state, wherein the control device determines if a condition for the split-flow state is satisfied; and when in the connected state, the control device controls the opening/closing device to maintain the connected state as long as one of the first actuator and the second actuator is in a driven state.

2. The control system according to claim 1, further comprising an operating device manipulated to drive the actuators.

3. The control system according to claim 1, wherein in the split-flow state, the first hydraulic pump supplies the hydraulic fluid to a first actuator group to which the first actuator belongs, and in the split-flow state, the second hydraulic pump supplies the hydraulic fluid to a second actuator group to which the second actuator belongs, and the working unit components include a bucket, an arm coupled to the bucket, and a boom coupled to the arm, additional actuators include a bucket cylinder configured to operate the bucket, an arm cylinder configured to operate the arm, and a boom cylinder configured to operate the boom, the bucket cylinder and the arm cylinder belong to the first actuator group, and the boom cylinder belongs to the second actuator group.

4. The control system according to claim 3, wherein the work machine includes a swing structure supporting the working unit, and the swing structure is driven by an actuator that does not belong to the first actuator group and the second actuator group.

5. A control method for controlling a work machine including a working unit having a plurality of working unit components, and a plurality of actuators, configured to drive the respective working unit components, the control method comprising:

switching between a split-flow state in which a passage connecting a first hydraulic pump and a second hydraulic pump is closed and a connected state in which the passage is open;

supplying hydraulic fluid discharge from the first hydraulic pump to a first actuator, one of the plurality of actuators, and supplying hydraulic fluid discharged from the second hydraulic pump to a second actuator, one of the plurality of actuators, in the split-flow state; and if a condition for the split-flow state is satisfied; and when in the connected state, the control method maintains the connected state as long as one of the first actuator and the second actuator is in a driven state.

* * * * *